US009375730B2

(12) United States Patent
Inaniwa et al.

(10) Patent No.: US 9,375,730 B2
(45) Date of Patent: Jun. 28, 2016

(54) CENTRIFUGE WITH COMPRESSOR MOTOR FEEDBACK CONTROL DEVICE

(75) Inventors: Masahiro Inaniwa, Ibaraki (JP); Hiroyuki Takahashi, Ibaraki (JP); Kouichi Akatsu, Ibaraki (JP); Hisanobu Ooyama, Ibaraki (JP); Yuki Hodotsuka, Ibaraki (JP); Hidetaka Osawa, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 1072 days.

(21) Appl. No.: 13/446,497

(22) Filed: Apr. 13, 2012

(65) Prior Publication Data

US 2012/0260687 A1 Oct. 18, 2012

(30) Foreign Application Priority Data

Apr. 15, 2011 (JP) ..... 2011-091601
Mar. 2, 2012 (JP) ..... 2012-047418
Mar. 28, 2012 (JP) ..... 2012-075188

(51) Int. Cl.
*B04B 13/00* (2006.01)
*B04B 15/02* (2006.01)
*B04B 9/10* (2006.01)

(52) U.S. Cl.
CPC . *B04B 15/02* (2013.01); *B04B 9/10* (2013.01); *B04B 13/00* (2013.01)

(58) Field of Classification Search
CPC ..... B04B 9/10; B04B 13/00; B04B 15/02
USPC ..... 494/1, 10–16, 23–30, 35, 43, 61, 85; 62/196.1, 228.1, 259.2
See application file for complete search history.

(56) References Cited

U.S. PATENT DOCUMENTS 6,866,621 B1 * 3/2005 Muller et al. ..... 494/7
7,181,923 B2 * 2/2007 Kurita et al. ..... 62/228.4

(Continued)

FOREIGN PATENT DOCUMENTS

CN 1557561 A 12/2004
CN 101767066 A 7/2010

(Continued)

OTHER PUBLICATIONS

Chinese Office Action for the related Chinese Patent Application No. 201210111443.9 dated Jun. 24, 2015.
Japanese Office Action for the related Japanese Patent Application No. 2012-075188 dated Aug. 24, 2015.

*Primary Examiner* — Charles Cooley
(74) *Attorney, Agent, or Firm* — Kenealy Vaidya LLP

(57) ABSTRACT

A centrifuge including: a rotor configured to be driven by a motor and to hold a sample, a centrifuge inverter, a chamber accommodating the rotor, a temperature sensor configured to detect the temperature of the chamber, a cooling machine configured to cool the chamber and including a compressor, a compressor inverter, a compressor motor configured to be controlled in a variable speed and a control device, wherein the control device carries out a feedback control of the compressor motor based on a preset temperature and a detected temperature of the temperature sensor when the rotation number of the compressor motor is larger than a predetermined rotation number, and the control device carries out an intermittent control for turning ON-OFF the cooling function of the compressor when the rotation number of the compressor motor is smaller than a predetermined rotation number.

24 Claims, 27 Drawing Sheets

(56) References Cited

U.S. PATENT DOCUMENTS

| | | | | |
|---|---|---|---|---|
| 7,975,497 | B2 * | 7/2011 | Kaga et al. | 62/228.3 |
| 8,192,343 | B2 * | 6/2012 | Spiegel et al. | 494/14 |
| 9,056,320 | B2 * | 6/2015 | Watahiki | B04B 13/00 |
| 2004/0023778 | A1 | 2/2004 | Kusumoto et al. | |
| 2008/0300124 | A1 * | 12/2008 | Akatsu et al. | 494/14 |
| 2011/0160030 | A1 * | 6/2011 | Heilmann et al. | 494/14 |
| 2012/0260687 | A1 * | 10/2012 | Inaniwa et al. | 62/196.1 |
| 2014/0024516 | A1 * | 1/2014 | Kusumoto et al. | 494/1 |
| 2014/0031191 | A1 * | 1/2014 | Inaniwa et al. | 494/9 |
| 2014/0045669 | A1 * | 2/2014 | Osawa et al. | 494/9 |
| 2014/0121094 | A1 * | 5/2014 | Hodotsuka | 494/7 |

FOREIGN PATENT DOCUMENTS

| | | | |
|---|---|---|---|
| EP | 0 344 444 | A3 | 10/1990 |
| EP | 0 602 639 | A1 | 6/1994 |
| JP | 2-35951 | A | 2/1990 |
| JP | 5-228400 | A | 9/1993 |
| JP | 5-228401 | A | 9/1993 |
| JP | 6-170282 | A | 6/1994 |
| JP | 7-246351 | A | 9/1995 |
| JP | 9-984 | | 1/1997 |
| JP | 2008-70031 | A | 3/2008 |
| JP | 2012-11358 | A | 1/2012 |

* cited by examiner

FIG. 4

| TERM NUMBER | ALLOWABLE RATED INPUT POWER OF AC POWER SUPPLY (1) | | | DISTRIBUTION PARAMETER | | | |
|---|---|---|---|---|---|---|---|
| | RATED VOLTAGE (V) | RATED CURRENT (A) | ALLOWABLE INPUT POWER (W) | ROTATION NUMBER (Hz) OF COMPRESSOR MOTOR (13)/ POWER (W) DURING ACCELERATION | POWER (W) OF CENTRIFUGE MOTOR (9) DURING ACCELERATION | CURRENT (A) OF CURRENT SENSOR (19) OF CENTRIFUGE MOTOR DURING ACCELERATION | ROTATION NUMBER (Hz) OF COMPRESSOR MOTOR (13) AFTER STABILIZATION |
| 1 | SINGLE PHASE 240 | 21 | 5040 | 58/2400 | 2640 | 11.00 | 67 |
| 2 | SINGLE PHASE 230 | 22 | 5060 | 58/2400 | 2660 | 11.56 | 67 |
| 3 | SINGLE PHASE 220 | 23 | 5060 | 58/2400 | 2660 | 12.09 | 67 |
| 4 | SINGLE PHASE 208 | 24 | 4992 | 58/2400 | 2792 | 12.46 | 67 |
| 5 | THREE PHASE 400 | 15/PHASE | 6900 | 58/2400 | 3450 | 15.00 | 67 |
| 6 | THREE PHASE 400 | 30/PHASE | 13800 | 58/2400 | 3900 | 16.95 | 67 |
| 7 | SINGLE PHASE 200 | 30 | 6000 | 58/2400 | 3600 | 18.00 | 65 |
| 8 | SINGLE PHASE 220 | 30 | 6600 | 58/2400 | 3600 | 18.00 | 65 |

FIG. 7

| TERM NUMBER | TYPE OF ROTOR | DISTRIBUTION PARAMETER (AC POWER SUPPLY 1: RATED VOLTAGE: SINGLE PHASE 200V, RATED CURRENT: 30A) | | | |
|---|---|---|---|---|---|
| | | ROTATION NUMBER (Hz) OF COMPRESSOR MOTOR (13)/ POWER (W) DURING ACCELERATION | POWER (W) OF CENTRIFUGE MOTOR (9) DURING ACCELERATION | CURRENT (A) OF CURRENT SENSOR (19) OF CENTRIFUGE MOTOR DURING ACCELERATION | ROTATION NUMBER (Hz) OF COMPRESSOR MOTOR (13) AFTER STABILIZATION |
| 1 | R22A4 TYPE (SMALL CAPACITY HIGH SPEED ROTATING ROTOR) | 64/2648 | 3352 | 16.76 | 65 |
| 2 | R15A TYPE (MEDIUM CAPACITY MEDIUM SPEED ROTATING ROTOR) | 58/2400 | 3600 | 18.00 | 65 |
| 3 | R10A3 TYPE (LARGE CAPACITY LOW SPEED ROTATING ROTOR) | 50/2070 | 3930 | 19.65 | 65 |

FIG. 14

| RATIO (%) OF PRESET ROTATION NUMBER TO MAXIMUM ROTATION NUMBER | ROTATION NUMBER (Hz) OF COMPRESSOR MOTOR (13) |
|---|---|
| 100 | 65 |
| 95 | 64 |
| 90 | 61 |
| 85 | 53 |
| 80 | 45 |
| 75 | 38 |
| 70 | 31 |
| BELOW 65 | 30 |

| TERM NUMBER | TYPE OF ROTOR (31) | ROTATION NUMBER (Hz) OF CONDENSER FAN (18) |
|---|---|---|
| 1 | R22A4 TYPE (SMALL CAPACITY HIGH SPEED ROTATING ROTOR) | 60 |
| 2 | R15A TYPE (MEDIUM CAPACITY MEDIUM SPEED ROTATING ROTOR) | 54 |
| 3 | R10A3 TYPE (LARGE CAPACITY LOW SPEED ROTATING ROTOR) | 50 |

CENTRIFUGE WITH COMPRESSOR MOTOR FEEDBACK CONTROL DEVICE

CROSS-REFERENCE TO RELATED APPLICATIONS

This application claims priority from Japanese Patent Application No. 2011-091601 filed on Apr. 15, 2011, Japanese Patent Application No. 2012-047418 filed on Mar. 2, 2012, and Japanese Patent Application No. 2012-075188 filed on Mar. 28, 2012, the entire contents of which are incorporated herein by reference.

TECHNICAL FIELD

Aspects of the present invention relate to a centrifuge capable of corresponding to various power supply situation without changing a configuration thereof, achieving reduction in size and low noise and realizing high-precision temperature control.

BACKGROUND

A centrifuge, in particular, a so-called high-speed refrigerated centrifuge has been widely used in the experimental laboratory or the routine operation of manufacturing process in which ability for cooling and maintaining the rotor rotating at high speed at a lower temperature (for example, 4° C.) and ability for accelerating or decelerating the rotor in a short time are required. This centrifuge is a device capable of obtaining samples centrifuged by holding a sample placed in tube/bottle to be separated and precipitated on a rotor, accelerating and then stabilizing the rotor set on crown in a chamber to a predetermined rotation number and then decelerating and stopping the rotor.

In a related-art high-speed refrigerated centrifuge, it is usual that the centrifuging time of a sample is not so long and thus it is important to improve the collection efficiency of separated and precipitated material by reducing acceleration/deceleration time of a rotor. Accordingly, it is especially demanded that the acceleration/deceleration time is short. Further, when a sample is separated and precipitated during centrifuging operation, in order to prevent the separated and precipitated sample from being deteriorated due to decrease in biochemical activity and temperature, there is need an ability for accurately retaining the sample held in the rotor at a lower temperature (for example, 4° C.) during centrifuging operation. In addition, small installation space and compact size are also important. Furthermore, since the centrifuge is often used in a quiet ambient environment such as research room or experimental laboratory, it is also important to reduce an operating noise.

Meanwhile, the destination (shipping address) of the centrifuge is worldwide, and thus, the power situation varies for each country. For this reason, in related-art, the centrifuge is configured to cover voltage/frequency/power supply capacity of power sources by one design specification. In a general configuration of a product commercially available from the present applicant, a motor for accelerating/decelerating a rotor is subjected to a variable speed control by an inverter and both a compressor motor and a radiator fan of a cooling unit for holding a sample at a lower temperature are subjected to ON-OFF control by a single-phase induction motor.

A technology of using a variable speed compressor of an inverter control type has been proposed in JP-A-H07-246351. The technology disclosed in JP-A-H07-246351 has a configuration that the current supplied from the power supply or returned to the power supply forms a current waveform in which the power factor is high and the harmonic current is reduced, when a motor for rotationally driving the rotor is subjected to the power running and the power regeneration operation. Further, the technology disclosed in JP-A-H06-170282 is so configured that the rotation number of a cooling fan in a region where the power frequency supplied is 60 Hz is reduced to be consistent with the rotation number thereof in a region where the power frequency is 50 Hz and the noise level of the cooling fan generated due to the change of the power frequency is not fluctuated. The technology disclosed in JP-A-H05-228400 relates to a centrifuge for controlling ON-OFF of a compressor motor of a cooling unit. In this centrifuge, a bypass pipe connecting a high-pressure side pipe and a lower-pressure side pipe and a switch are provided. As the compressor is stopped, the switch is opened to eliminate the pressure difference between the high-pressure side pipe and the lower-pressure side pipe in a short time and thus a pressure condition required for restart of the compressor can be achieved.

SUMMARY

In related art, in order to use one design specification as much as possible for each power voltage for each destination, an autotransformer is provided to the power input unit of the centrifuge. This is for controlling a centrifuge motor, a compressor motor and a radiator fan, which are usually difficult to match the power supply voltage. A tap of the autotransformer is switched so that each power voltage matches an inner operating voltage of the centrifuge. At this time, the current capacity of the connection power is varies. Accordingly, when the power supply capacity is small, the current of the centrifuge motor during acceleration of the rotor is adapted to the voltage specification having smallest current capacity and does not exceed the power supply capacity. In this way, the acceleration of the rotor becomes blunt. Alternatively, the operation of the compressor motor of the cooling machine is stopped until the end of the acceleration of the rotor in order to allocate the power supply voltage to acceleration of the rotor. In this case, the rotor is allowed to be warmed due to windage loss generated by the rotation thereof. However, when this control method is adopted, original function of the centrifuge is deteriorated.

In related-art, a compressor motor and a radiator fan has been utilized, in which the rotation number of the motor is changed as the power frequency changes and thus cooling capacity is also changed. At this time, a compressor motor having a large capacity is employed, in order to ensure sufficient cooling capacity even at 50 Hz power supply at which the circulation amount of the refrigerant is reduced due to decrease in the rotation number thereof. Similarly, radiator fan having a large size is employed, in order to ensure sufficient heat discharge even at 50 Hz power supply at which the heat discharge amount of the radiator is reduced due to decrease in the rotation number thereof. However, when these compressor motor and condenser fan are used at 60 Hz power supply, the rotation number of the motor or the fan rises and thus operating noise becomes larger. A product incorporating sound insulating and noise barrier equipment has been commercialized in order to suppress the operating noise. This is the same as in a cooling fan of the motor for driving the rotor and a cooling fan for the control device.

In a related-art temperature control of the rotor, ON-OFF control of the compressor motor is carried out by setting the rotation number of the compressor motor to a single rotation number depending on the power frequency. According to this control, temperature control accuracy is degraded in a region where the temperature of the rotor is greatly pulsated during rotation thereof or the windage loss of the rotor is small. As a countermeasure, a method for utilizing a variable speed compressor in an inverter control type has been proposed. However, according to this method, in a case of a control in which intermittent ON-OFF operation as well as continuous variable speed operation is required, the temperature control performance of the rotor is poor at boundary region between the continuous variable speed operation and the intermittent ON-OFF operation, at which region the windage loss of the rotor is small. Accordingly, high-precision temperature control cannot be achieved.

The present invention has been made to solve the above-described problem and it is an object of the present invention to provide a centrifuge capable of controlling a compressor motor with high precision by carrying out a feedback of the detected temperature of the temperature sensor for measuring the temperature of the rotor and using difference between the target control temperature of the rotor and the detected temperature of the temperature sensor.

Another object of the present invention is to provide a centrifuge capable of preventing the rotor from being subjected to a large temperature pulsation due to ON-OFF control of the compressor motor during rotation of the rotor.

Yet another object of the present invention is to provide a centrifuge capable of achieving high-precision temperature control accuracy even in a region where the windage loss of the rotor is small.

Representative aspects of the invention disclosed herein are as follows.

In a first aspect, there is provided a centrifuge including: a rotor configured to be driven by a motor and to hold a sample; a centrifuge inverter configured to supply power to drive the motor; a chamber accommodating the rotor; a temperature sensor configured to detect the temperature of the chamber; a cooling machine configured to cool the chamber and including a compressor; a compressor inverter configured to supply power to the compressor; a compressor motor incorporated to the compressor and configured to be controlled in a variable speed by the power supplied from the compressor inverter; and a control device configured to control the centrifuge inverter and the compressor inverter based on set centrifuging operation conditions, wherein the control device carries out a feedback control of the compressor motor based on a preset temperature and a detected temperature of the temperature sensor when the rotation number of the compressor motor is larger than a predetermined rotation number, and the control device carries out an intermittent control for turning ON-OFF the cooling function of the compressor when the rotation number of the compressor motor is smaller than a predetermined rotation number.

In a second aspect, the rotation number of the compressor motor, which is compared with the predetermined rotation number, is calculated by the control device by using a difference between the preset temperature and the detected temperature of the temperature sensor.

In a third aspect, the calculation is a PID calculation.

In a fourth aspect, the centrifuge further includes an input unit to which the preset temperature is input, wherein the control device is configured to set a target control temperature for making the rotor to the preset temperature based on the inputted preset temperature and is configured to carry out a feedback control of the compressor motor based on the target control temperature and the detected temperature of the temperature sensor.

In the fifth aspect, the control device controls the cooling function of the compressor to ON state when, during the intermittent control, the detected temperature of the temperature sensor is higher than the target control temperature and the rotation number of the compressor motor is larger than a set minimum continuous rotation number.

In a sixth aspect, the control device is configured to stop the intermittent control and transit to the feedback control when the detected temperature of the temperature sensor is higher than the target control temperature for a predetermined continuous time during the intermittent control.

In a seventh aspect, the temperature sensor is installed to contact with a metal part of a lower portion of the chamber.

In an eighth aspect, the control device monitors whether a state where the rotation number of the compressor motor is lower than a predetermined rotation number has continued for the predetermined time or not and whether the rotation number of the compressor motor has reached a set minimum continuous rotation number or not, and when it is determined that the state where the rotation number of the compressor motor is lower than a predetermined rotation number has continued for the predetermined time or the rotation number of the compressor motor has reached the set minimum continuous rotation number, the control device carries out an intermittent control of the cooling function of the compressor.

In a ninth aspect, the control device is configured to control the compressor motor to ON state or OFF state during the intermittent control.

In a tenth aspect, when the compressor motor is controlled to OFF state during the intermittent control, the OFF state is maintained for at least a minimum off time.

In an eleventh aspect, the centrifuge further includes: an evaporator, a supply line for supplying a refrigerant compressed by the compressor to the evaporator, a return line extending from the evaporator to the compressor, a bypass line for bypassing the evaporator by shorting the return line and the supply line, and a valve provided in the bypass line, wherein the control device is configured to control the valve to ON state or OFF state during the intermittent control.

In a twelfth aspect, the control device is configured to control the compressor motor to rotate at the minimum continuous rotation number when the valve is controlled to OFF state.

In a thirteenth aspect, the control device is configured to control the valve to ON state or OFF state and is configured to control the compressor motor to a continuous operation state or an intermittent operation state during the intermittent control.

In a fourteenth aspect, the control device is configured to control the ON time of the valve to be shorter than the interval of the intermittent operation when the compressor motor is controlled to the intermittent operation state.

In a fifteenth aspect, when the rotation number obtained by the calculation which uses the detected temperature of the temperature sensor as a feedback information and is based on a difference between the target control temperature and the detected temperature of the temperature sensor is higher than the minimum continuous rotation number at the start of the temperature control of the rotor, a rotation number, which is obtained by multiplying a coefficient obtained from a ratio of the preset rotation number of the rotor and a settable maximum rotation number of the rotor to a maximum continuous rotation number, is used as the preset rotation number of the compressor motor.

In a sixteenth aspect, when the rotation number obtained by the calculation which uses the detected temperature of the temperature sensor as a feedback information and uses a difference between the target control temperature and the detected temperature of the temperature sensor is higher than the minimum continuous rotation number at the start of the temperature control of the rotor, a rotation number, which is obtained by multiplying an amount of heat generation of the rotor calculated from a windage loss coefficient of the rotor registered in advance and a rotating speed of the rotor during operation as a coefficient to the maximum continuous rotation number, is used as the preset rotation number of the compressor motor.

In a seventeenth aspect, there is provided a centrifuge including: a rotor configured to be driven by a motor and to hold a sample; a chamber accommodating the rotor; an evaporator configured to cool the chamber; a compressor configured to compress a refrigerant which is supplied to the evaporator in a circulation manner; a capillary provided between the compressor and the evaporator; a return line connecting the evaporator and the compressor; a bypass line that connects an inlet side of the capillary and the return line; a valve that allows the refrigerant to flow the bypass line; and a throttle part provided to a part of the bypass line.

In a eighteenth aspect, the throttle part is formed by narrowing the diameter of the bypass line, and a sectional area of the throttle part is set larger than a minimum sectional area of the capillary and smaller than a minimum sectional area of the return line.

In a nineteenth aspect, a condenser configured to heat-dissipate the refrigerant compressed by the compressor is provided between the compressor and an inlet of the capillary.

In a twentieth aspect, the centrifuge further includes a switching means configured to switch a flow of the refrigerant flowing from the compressor to the capillary to a flow toward the bypass line.

In a twenty-first aspect, the valve is a variable valve in which the flow rate can be adjusted in a variable manner and serves as the throttle part by adjusting the flow rate thereof.

In a twenty-second aspect, the centrifuge further includes a control device configured to control the intermittent operation or the continuous operation of the compressor, wherein the control device is configured to control ON-OFF of the valve during the intermittent operation or the continuous operation.

In a twenty-third aspect, the centrifuge further includes a control device configured to control open-close of the valve when the rotation number of the compressor motor becomes lower than a predetermined rotation number.

In a twenty-fourth aspect, the control device is configured to control ON-OFF of the motor when the rotation number of the compressor motor becomes lower than a predetermined rotation number, and the control device is configured to switch the valve from the open state to the closed state at least during OFF state of the motor.

According to the first aspect, the control device carries out a feedback control of the compressor motor based on a preset temperature and a detected temperature of the temperature sensor when the rotation number of the compressor motor is larger than a predetermined rotation number and the control device carries out an intermittent control for turning ON-OFF the cooling function of the compressor when the rotation number of the compressor motor is smaller than a predetermined rotation number. By this configuration, it is possible to realize a centrifuge capable of achieving high-precision temperature control even in a region where the windage loss of the rotor is small.

According to the second aspect, since the rotation number of the compressor motor is obtained by a calculation of the control device, it is possible to obtain the rotation number of the compressor motor in a high precision in accordance with the detected temperature.

According to the third aspect, since the calculation is a PID calculation, it is possible to accurately control the temperature of the rotation chamber using a temperature feedback control including a proportional term, an integration term and a differential term.

According to the fourth aspect, the control device carries out a feedback control of the compressor motor based on the target control temperature and the detected temperature of the temperature sensor. Accordingly, it is possible to accurately control the temperature of the rotation chamber to a target control temperature.

According to the fifth aspect, the control device controls the cooling function of the cooling machine to ON state when the detected temperature of the temperature sensor is higher than the target control temperature and the rotation number of the compressor motor is larger than a set minimum continuous rotation number, during the intermittent control. By this configuration, it is possible to realize a centrifuge in which there is no possibility of insufficient cooling of the rotor.

According to the sixth aspect, the intermittent control is stopped when the detected temperature is higher than the target control temperature during the intermittent control and the feedback control is carried out. Accordingly, it is possible to effectively cool the rotation chamber without causing an insufficient cooling of the rotor.

According to the seventh aspect, since the temperature sensor is installed to come into contact with a metal part of a lower portion of the chamber, it is possible to realize a centrifuge capable of suitably responding to the temperature change of the evaporator and having a high-precision cooling performance.

According to the eighth aspect, the control device carries out an intermittent control of the cooling function of the cooling machine when it is determined that the state where the rotation number of the compressor motor is lower than a predetermined rotation number has continued for the predetermined time or the rotation number of the compressor motor reaches the set minimum continuous rotation number. Accordingly, a sufficient cooling can be achieved so that a re-rising time of temperature to the target control temperature is ensured for a predetermined time when the compressor motor is controlled to OFF state.

According to the ninth aspect, since the control device controls the compressor motor to ON state or OFF state during the intermittent control, it is possible to realize a centrifuge having a high-precision even in a state where the cooling of the rotation chamber may be weak.

According to the tenth aspect, the OFF state is maintained over at least minimum off time when the compressor motor is controlled to OFF state. By this configuration, the oil lubrication of the compressor is sufficiently done and the compressor is migrated to ON state when the pressure difference between the suction pipe and the discharge pipe is smaller than a predetermined value. As a result, a long service life of the compressor can be expected.

According to the eleventh aspect, a bypass line for bypassing the evaporator by shorting the return line from the supply line and an electrically opened/closed valve provided in the bypass line are provided. Accordingly, it is possible to adjust the cooling capacity of the compressor while intermittently controlling the valve to ON or OFF state and without stopping the compressor.

According to the twelfth aspect, the control device controls the compressor motor to rotate at the minimum continuous rotation number when the valve is controlled to OFF state. By this configuration, it is possible to maintain the cooling state without stopping the compressor.

According to the thirteenth aspect, the control device controls the valve to ON state or OFF state during the intermittent control and controls the compressor motor to a continuous operation state or an intermittent operation state. Accordingly, it is possible to eliminate or reduce constraints on restart inhibit time of the compressor when the compressor motor is stopped.

According to the fourteenth aspect, the control device controls the ON time of the valve to be shorter than the interval of the intermittent operation when the compressor motor is controlled to the intermittent operation state. Accordingly, it is possible to eliminate or reduce constraints on restart inhibit time of the compressor.

According to the fifteenth aspect, the rotation number obtained by multiplying a coefficient obtained from a ratio of the preset rotation number of the rotor and a settable maximum rotation number of the rotor to a maximum continuous rotation number is used as the preset rotation number of the compressor motor, when the calculated rotation number is higher than the minimum continuous rotation number. By this configuration, it is possible to prevent the temperature of the rotor from being excessively dropped due to the start of PID control at excessive rotation number.

According to the sixteenth aspect, the rotation number obtained by multiplying a coefficient as the amount of heat generation of the rotor calculated from a windage loss coefficient of the rotor registered in advance and a rotating speed of the rotor during operation to the maximum continuous rotation number is used as the preset rotation number of the compressor motor, when the calculated rotation number is higher than the minimum continuous rotation number. By this configuration, it is possible to prevent the temperature of the rotor from being excessively dropped due to the start of PID control at excessive rotation number.

According to the seventeenth aspect, since the bypass line connecting the inlet side of the capillary and the return line and the valve are provided, it is possible to flow most of the refrigerant toward the bypass line, not toward the capillary side by controlling open-close of the valve. Further, since the throttle part is provided in the bypass line connecting the inlet side of the capillary and the return line, the refrigerant flowing through a part of the bypass line having small sectional area can be vaporized in the return line and the refrigerant can return to the compressor in a vaporized state. In this way, it is possible to prevent the service life of the compressor from being reduced.

According to the eighteenth aspect, since the throttle part is formed by narrowing the diameter (inner diameter) of the bypass line, the present invention can be realized just by properly selecting the type of pipe without preparing special member. Further, since the sectional area of the throttle part is set larger than a minimum sectional area of the capillary and smaller than a minimum sectional area of the return line, it is possible to smoothly flow a large amount of refrigerant to the bypass line.

According to the nineteenth aspect, since a condenser for dissipating heat of the refrigerant compressed by the compressor is provided between an outlet of the compressor and an inlet of the capillary, it is possible to effectively cool high-temperature refrigerant compressed by the compressor.

According to the twentieth aspect, since a switching means is provided to switch a flow of the refrigerant flowing from the compressor to the capillary into a flow toward the bypass line, it is possible to effectively control the flow of refrigerant toward the evaporator. In this way, the temperature of the chamber can be accurately controlled.

According to the twenty-first aspect, since a valve means for narrowing or opening/closing a flow passage is provided in the bypass line and is used as the throttle part, it is possible to effectively adjust the flow of refrigerant toward the evaporator by controlling open-close of the valve means.

According to the twenty-second aspect, since ON-OFF of the valve is controlled by the control device during the continuous operation of the compressor, it is possible to adjust the temperature of the chamber in accordance with ON-OFF of the valve. Further, since ON-OFF of the valve is controlled by the control device during the intermittent operation of the compressor, it is possible to balance pressures in an inlet side and an outlet side of the compressor in a short time after the compressor motor is stopped. In this way, it is possible to eliminate or reduce constraints on restart inhibit time of the compressor.

According to the twenty-third aspect, since the control device controls open-close of the valve when the rotation number of the compressor motor becomes lower than a predetermined rotation number, it is possible to control ON-OFF of the cooling function of the compressor without stopping the compressor motor. In this way, it is possible to prevent the compressor from going to a low-speed rotation state in which the compressor cannot rotate. In addition, it is possible to eliminate or reduce constraints on restart inhibit time of the compressor after the compressor motor is stopped.

According to the twenty-fourth aspect, the control device controls ON-OFF of the motor when the rotation number of the compressor motor becomes lower than a predetermined rotation number and the control device switches the valve from the open state to the closed state at least during OFF state of the motor. By this configuration, the valve is in an open state when the motor is restarted and thus the refrigerant cannot flow into the bypass line. Accordingly, it is possible to cause the cooling function of the compressor to be in ON state as early as possible.

BRIEF DESCRIPTION OF DRAWINGS

FIG. 4 is a table illustrating an example of the distribution parameters of AC source current stored in the control device of the centrifuge according to the exemplary embodiment of the present invention;

FIG. 7 is a view for explaining a relationship between the type of the rotor and the power distribution in the centrifuge according to a second exemplary embodiment of the present invention;

FIG. 14 is a view illustrating a relationship between a ratio of a preset rotation number to a maximum rotation number of a rotor 31 and an initial rotation number of a compressor motor 13 at the start of control thereof;

DETAILED DESCRIPTION

Figure 1:
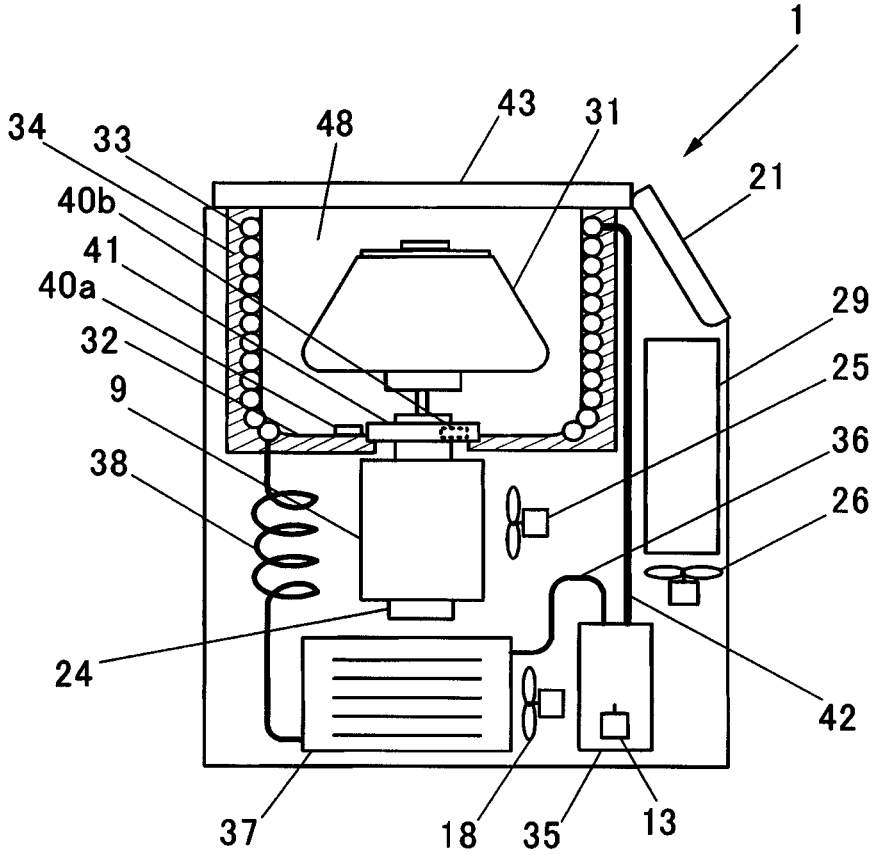
FIG. 1 is a sectional view schematically illustrating the entire configuration of a centrifuge according to an exemplary embodiment of the present invention.

Hereinafter, the exemplary embodiment of the present invention will be described by referring to the accompanying drawings. In the following drawings, same reference numerals will be given to the same components and a repetitive description thereof will be omitted.

FIG. 1 is a sectional view schematically illustrating the entire configuration of a centrifuge 1 according to an exemplary embodiment of the present invention. The centrifuge 1 includes a rotation chamber 48 inside a body thereof. A centrifuge motor 9 as a driving source is provided below the rotation chamber. As the centrifuge motor 9, a high-frequency induction motor in which a variable speed control by an inverter is allowed or a magnet brushless synchronous motor is utilized. A rotation sensor 24 for detecting a rotation number of an output shaft (motor shaft) is provided on a lower portion of the centrifuge motor 9 and a DC fan 25 for cooling the centrifuge motor 9 is provided on a side portion thereof. A rotor 31 is detachably mounted on a leading end of the output shaft (motor shaft) which extends upward from the centrifuge motor 9 to an interior of a chamber 32. The chamber 32 is an approximately cylindrical vessel and provided at its upper portion with a circular opening. The circular opening on an upper side of the chamber 32A is covered with a door 43 in which an insulation material is embedded. The door is configured to open and close the rotation chamber of the rotor 31. The door 43 is locked in a closed state by a lock mechanism (not-illustrated) during the operation of the centrifuge 1.

A pipe evaporator 33 is wound around an outer periphery of the chamber 32. The surrounding of the chamber is thermally insulated by an appropriate insulation material 34 such as a blowing agent. A compressor 35 is provided for compressing a refrigerant to supply the refrigerant in a circulation manner and includes a compressor motor 13. The compressor supplies the compressed refrigerant from a discharge pipe 36 to a condenser 37. The refrigerant is radiated and cooled by wind from a condenser fan 18 of the condenser 37 so that the refrigerant is liquefied. Further, the refrigerant is sent to a lower portion of the evaporator 33 wound around the outer periphery of the chamber 32 through a capillary 38. The heat is generated in the rotation chamber 48 due to a windage loss during the rotation of the rotor 31 and absorbed in vaporization heat generated during the evaporation of the refrigerant in the evaporator 33. Vaporized refrigerant is discharged from the top of the evaporator 33 and returns to the compressor 35 through a suction pipe 42. A temperature sensor 40*a* is provided at a portion contacting a metal part in a bottom of the chamber 32 in which the rotor 31 is accommodated and indirectly detects the temperature of the rotor 31. Further, a seal rubber 41 is made of a rubber and configured to plug a through-hole through which an output shaft of the centrifuge motor 9 penetrates. A temperature sensor 40*b* (illustrated in the dashed-line) is embedded in the seal rubber and used to indirectly detect the temperature of the rotor 31. Although two temperature sensors 40*a* and 40*b* are provided in the present exemplary embodiment, it is not essential to employ two temperature sensors. For example, only one of them may be used. Further, the temperature sensors may be provided in other locations. However, in this case, care must be taken because the detection accuracy can be changed when indirectly detecting the temperature of the rotor 31.

A control box 29 for accommodating a control device (will be described later) is provided inside of the centrifuge 1. The control device includes a micro computer, a timer and a storage device, etc., all of which are not illustrated. The control device is configured to control the whole of the centrifuge 1 including the rotation control of the centrifuge motor 9 and the operation control of a chiller for controlling the temperature of the rotation chamber 48. Accordingly, various electric equipments or electronic circuits are included inside of the control box 29 and respectively heat up when being operated. For this reason, a DC fan 26 for cooling is provided and sends cooling air to the electric equipments or electronic circuits when the control device is activated. The detected temperature of the temperature sensor 40*a* is fed back to the control device 20. The rotation number of a compressor motor 13 provided in the compressor 35 is so controlled that the sample in the rotor 31 reaches a predetermined target temperature. As mentioned above, five electric drive motors of the DC fan 25, the DC fan 26, the centrifuge motor 9, the compressor motor 13 and the condenser fan 18 are included in the centrifuge 1. However, three electric drive motors of the centrifuge motor 9, the compressor motor 13 and the condenser fan 18 are particularly involved in the present invention.

An operating panel 21 as an example of an input unit is provided on the top of the centrifuge 1. Preferably, the operating panel 21 is a touch-type liquid crystal display panel. Centrifuge operation conditions such as the operating rotation number (rotation speed) setting, the operation time setting and the cooling temperature setting of the rotor 31 holding the sample are inputted through the operating panel 21 and various information are displayed on the operating panel 21.

Figure 2:
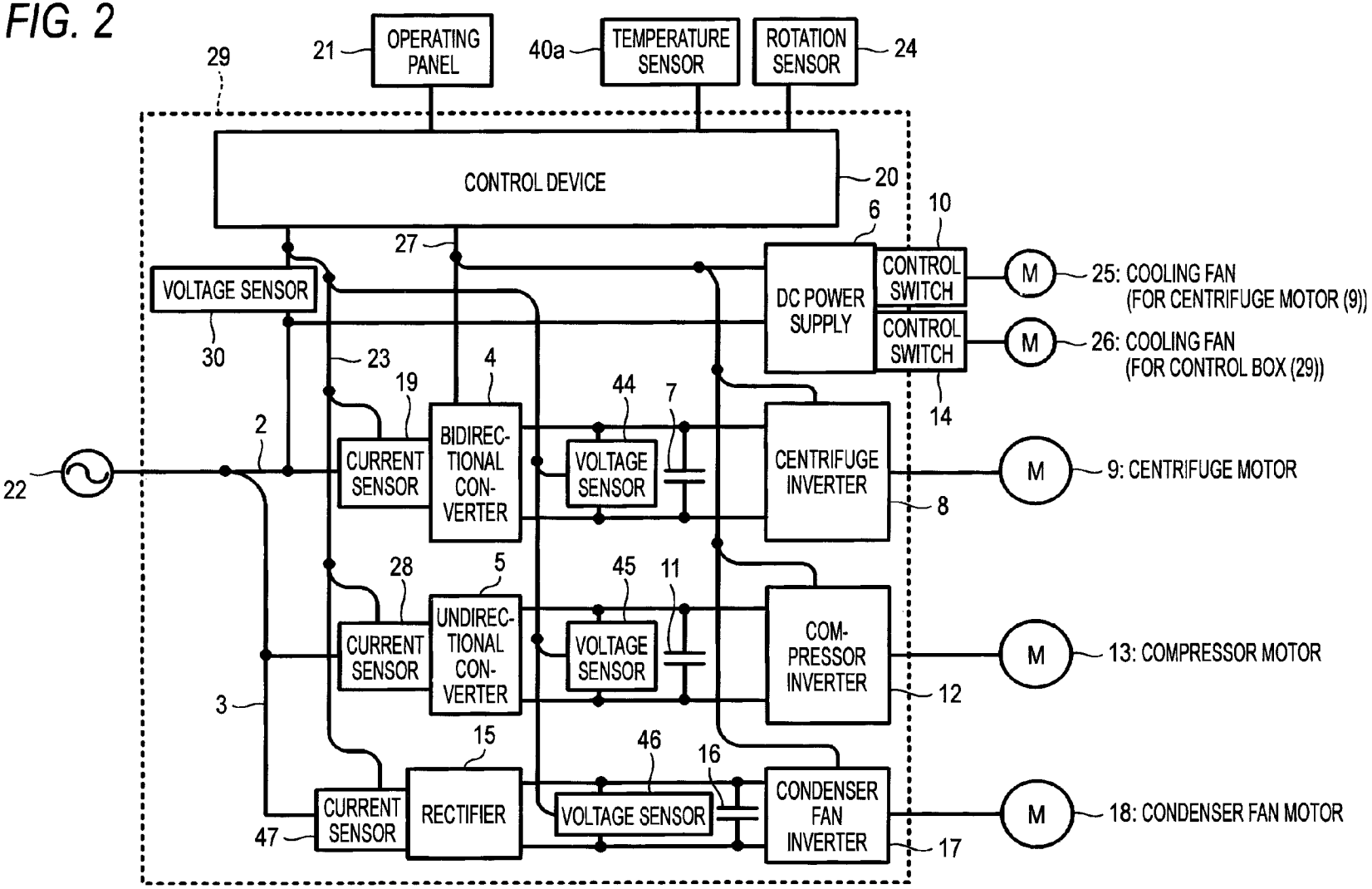
FIG. 2 is a block diagram illustrating the centrifuge according to the exemplary embodiment of the present invention.

FIG. 2 is a block diagram illustrating the centrifuge according to the exemplary embodiment of the present invention. As illustrated in the dashed line, the centrifuge is accommodated in the control box 29. In the configuration of FIG. 2, a power supply line 2 is connected to a single-phase AC power supply 22. Mainly, a bidirectional converter 4, a unidirectional converter 5, a rectifier 15 and a DC power supply 6 are connected to the power supply line 2. A centrifuge motor current sensor 19 can measure the current waveform in a state of being insulated. The bidirectional converter 4 is operated as a boost converter through the centrifuge motor current sensor 19 to convert the power of the AC power supply 22 into a DC power, during the power rectification. Further, the bidirectional converter is operated as a step-down converter to convert the DC power into AC power and regenerates the power of the AC power supply 22, during the power inversion. In this way, the bidirectional converter has a high power factor. DC power supply end of the bidirectional converter 4 is connected to a centrifuge inverter 8 via a smoothing condenser 7. Inversion terminal of the centrifuge inverter 8 is connected to the centrifuge motor 9 which is constituted by the high-frequency induction motor or the magnet brushless synchronous motor and configured to rotationally drive the rotor 31. The configuration and operation of the bidirectional converter 4 has been described in detail in JP-A-H07-246351. Specifically, AC side of the bidirectional converter is connected to the AC power supply 22 and DC side thereof is connected to the smoothing condenser 7. Further, a switching device such as a bipolar transistor, IGBT, FET, etc., are connected in opposite direction parallel to a plurality of rectifying devices constituting the bidirectional converter 4. Herein, the bidirectional converter 4 is not limited to such a configuration. For example, a related-art bidirectional converter may be used as the bidirectional converter.

When the centrifuge motor 9 is accelerated by supplying DC power to DC power supply end, the current waveform of the passing current has the same shape as and is phase-synchronous with the sinusoidal waveform of the supply voltage waveform while boosting the DC power to a constant DC voltage higher than a peak value of the supply voltage by the boost function of the bidirectional converter 4. Therefore, a receiving power factor is improved. During the regenerative deceleration of the centrifuge motor 9, the voltage of the DC power supply end is lowered by the step-down function of the bidirectional converter 4 while being substantially same as the supply voltage of AC power supply 22 and following the voltage waveform thereof. And, the current waveform of the passing current is same as the sine waveform of the supply voltage waveform and the flowing direction thereof is opposite to that of the sine waveform. Therefore, a power factor of a reverse power flow is improved and the power returns to the AC power supply 22. The output of the voltage sensor 44 is transmitted to the control device 20 via an input control line 23 and is monitored by the control device while being utilized in the control operations.

The power supply line 2 is also connected to the DC power supply 6. DC fan 25 and DC fan 26 are respectively connected to DC constant voltage output end of the DC power supply 6 via controls switches 10, 14 for controlling ON-OFF of the DC fan 25 and the DC fan 26. Further, the DC constant voltage output end of the DC power supply 6 is connected to the control device 20. A switching type stabilized power supply can be used as the DC power supply 6 and is capable of handling a wide range of supply voltage of the AC power supply 22. In this way, according to the present exemplary embodiment, it is possible to obtain a constant rotation number regardless of the power voltage/frequency by using each fan as DC fan, instead of AC fan. Further, it is also possible to securely obtain a constant cooling capacity.

The unidirectional converter 5 is connected to the AC power supply 22 via a compressor motor current sensor 28. The current sensor can measure the current waveform while insulating the current waveform. The current sensor converts the power of the AC power supply 22 into DC power in a high power factor. The DC power supply end of the unidirectional converter 5 is connected to a compressor inverter 12 while the smoothing condenser 11 is provided therebetween. The inversion terminal of the compressor inverter 12 is connected to the compressor motor 13 such as the high-frequency induction motor or the magnet brushless synchronous motor. The current waveform of the passing current has the same shape as and is phase-synchronous with the sine waveform of the supply voltage waveform while supplying DC power from the DC power supply end of the unidirectional converter 5 to the smoothing condenser 11 and boosting the DC power to DC power several tens of volts higher than the peak value of the AC power supply 22 by the boost function of the unidirectional converter. Therefore, a receiving power factor is improved. The charging voltage of the smoothing condenser 11 is supplied to the compressor inverter 12 and converted into AC voltage value by the compressor inverter 12 to drive the compressor motor 13. The rotation number of the compressor motor 13 is dependent on the frequency of the AC voltage and the maximum allowable rotation number thereof is slightly smaller than 120 Hz, that is, 7200 $min^{-1}$. The compressor motor 13 is always subjected to a reaction force for compressing the refrigerant. As soon as the power supply is shut-off, the compressor motor is decelerated and stopped and thus it is not possible to generate a regenerative power. Accordingly, there is no necessary a bidirectional conversion function by the bidirectional converter as in the case of the circuit of the centrifuge motor 9. A voltage sensor 45 is provided between the unidirectional converter 5 and the compressor inverter 12 and measures the charging voltage of the smoothing condenser 11 in a state of being insulated. The output of the voltage sensor 45 is transmitted to the control device 20 via an output control line 27 and is monitored by the control device while being utilized in the control operations.

The power of the AC power supply 22 is also supplied to a rectifier 15 via a power supply line 3. A DC output end of the rectifier 15 is connected to a condenser fan inverter 17 via the smoothing condenser 16. A condenser fan 18 including the high-frequency induction motor or the magnet brushless synchronous motor is connected to an output end of the condenser fan inverter 17. Power requirements of the centrifuge motor 9 and the compressor motor 13 are usually up to about 2 to 4 kW and the power requirements of the DC power supply 6 and the condenser fan 18 are about 100 W in total. It is not necessary to improve the power factor by a boost operation. Further, when it is necessary to suppress the power line harmonics, a reactor may be provided in a power input. When it is necessary to further suppress the power line harmonics, it may be preferable to improve the power factor.

From the output control line 27 of the control device 20, a selecting signal for causing the bidirectional converter 4 to operate in any one of a boost converter operation or a step-down converter operation and a selecting signal for causing the DC fans 25, 26 to operate in any one of a rotation mode or a stop mode by ON-OFF control of the control switches 10, 14 are outputted. Signal for performing voltage feedback control using pulse width modulation (PWM), for example, is outputted to each of the centrifuge inverter 8, the compressor inverter 12 and the condenser fan inverter 17 and further to each of the centrifuge motor 9, the compressor motor 13 and the condenser fan 18 in order to absorb the changes in the supply voltage and apply an appropriate voltage depending on the rotation status of these motors. A signal for variable speed control of a rotation number of the centrifuge motor 9 including ON and OFF by the control of the output voltage/output frequency is outputted to the centrifuge inverter 8. Similarly, in order to control the compressor motor 13 and the condenser fan 18 in the same manner as described above, a variable speed control of a rotation number thereof including ON and OFF are performed for each of the compressor inverter 12 and the condenser fan inverter 17. A method for controlling these motors is carried out by the control device 20 and is similar to a known VVVF control technology, or a sensor using vector control technology or sensorless vector control technology. These motors are driven by providing a suitable voltage and a slipping or a synchronous frequency depending on the rotation number of the motors.

Since the rectifier 15 of the condenser fan inverter 17 can respond to various voltages of the AC power supply 22 without using an expensive boost function, it is possible to achieve an inexpensive configuration of performing the voltage feedback control using pulse width modulation in order to use the operation voltage of the condenser fan 18 as a minimum voltage of the AC power supply 22 and respond to other high voltages of the AC power supply 22. A current sensor 47 and a voltage sensor 46 are provided on the condenser fan inverter 17 and can measure the current waveform in a state of being insulated. A signal thereof is inputted to the control device 20 via the input control line 23. The current of the condenser fan inverter 17 and the voltage of the smoothing condenser 16 can be monitored from the control device 20.

From the input control line 23 of the control device 20, inputted are a voltage monitoring signal of a voltage sensor 30 detecting the line voltage of the AC power supply 22, absorbing the changes in the voltage of the AC power supply 22 and causing the control device 20 to perform the voltage feedback control for each of the centrifuge inverter 8, the compressor inverter 12 and the condenser fan 18, a current monitoring signal of the centrifuge motor current sensor 19 provided in an input unit of the bidirectional converter 4 and detecting the current flowing in the bidirectional converter 4, a current monitoring signal of the compressor motor current sensor 28 provided in an input unit of the unidirectional converter 5 and detecting the current flowing in the unidirectional converter 5 and a signal of the rotation sensor 24 detecting the rotation number of the centrifuge motor 9.

The control device 20 is provided with the operating panel 21 for inputting centrifuge operation conditions such as the type, the operating rotation number setting, the operation time setting and the cooling temperature setting of the rotor 31 centrifuging the sample and storing the setting values. The control device is configured to output the distribution parameters of the source current of the AC power supply 22 connected thereto to the operating panel 21, depending on the setting values. Further, the control device 20 can store a supply voltage setting value and the allowable rated current as the parameters. The display contents of the operating panel 21 will be described by referring to FIG. 3.

In high-speed refrigerated centrifuge according to the present invention, 200V series are used as an input voltage and the rated supply voltage of the AC power supply 22 varies depending on the country of the destination. For example, in single-phase alternating current, 200V, 208V, 220V, 230V, or 240V is used as the rated supply voltage. Further, in three-phase alternating current, 400V is used as the rated supply voltage. However, in a case of the three-phase alternating current, a voltage between a power ground PE and each line is used as the rated supply voltage. Accordingly, in fact, 230V is used as a voltage between each phase. Typically, range of voltage fluctuation has a lower limit of −15% therefrom and an upper limit of +10% therefrom. Further, there is a need to respond to the supply voltage range of 170V to 264V. For example, rated power supply capacity of the AC power supply 22 on one side is 30 A, 24 A, 23 A, 22 A or 21 A in single-phase alternating current and 30 A or 15 A in three-phase alternating current. The power frequency is selected from 50Hz or 60Hz and the characteristics of the AC power supply are not affected due to the difference of the power frequency. However, any one of the power frequency is selectively utilized in other control and thus the power frequency is selected for the present. Such a power parameter is inputted via an operating screen of the operating panel 21 and stored in the control device.

Figure 3:
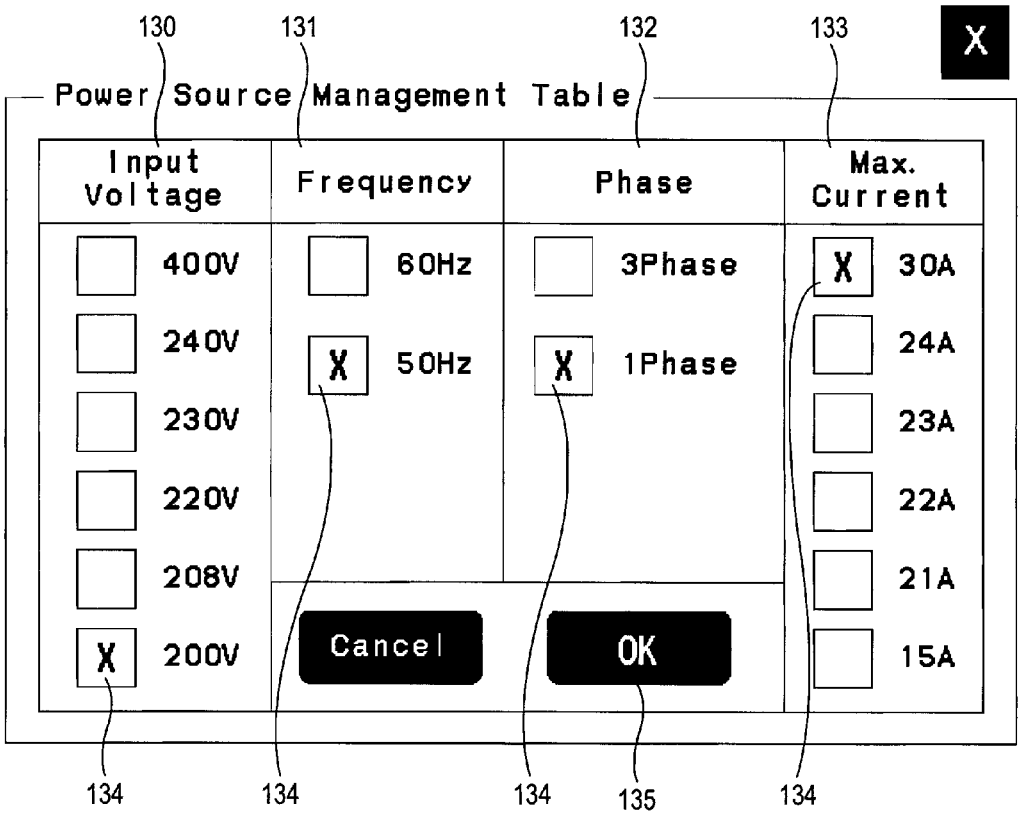
FIG. 3 is a view illustrating a display and operation screen of a setting means for setting the distribution parameters of AC source current of the centrifuge according to the exemplary embodiment of the present invention.

FIG. 3 illustrate a display example of the operating panel 21 in a state where a rated voltage of 200V, a power frequency of 50 Hz, a rated current of 30 A and a single-phase alternating current condition are set as the power parameters. The rated voltage is listed in Input Voltage section 130, the frequency is listed in Frequency section 131, the number of phase is listed in Phase section 132 and the rated current is listed in Current section 133. By respectively placing a check mark 134 on any one of the numbers listed in each of the sections and pushing OK button 134, these checked setting values are stored in the control device 20. Herein, the rated voltage is selected depending on the power supply of the destinations. Such a setting operation is carried out by the manufacturer during the factory shipment of the centrifuge, for example. However, such a setting operation may be carried out again in a case where the destination is changed in a relay hub after the product shipment or in a case where a local worker uses a power supply different from the setting power supply during the factory shipment. In this case, the control device 20 determines the distribution ratio of the power to the centrifuge motor 9 and the compressor motor 13 based on the setting rated current.

In this example, a total input power is 6000 W as a result of 200V times 30 A and a fixed power consumption of the compressor motor 13 is 2400 W. And, the acceleration of the rotor 31 is controlled by a power of 3600 W remained after subtracting the fixed power consumption of 2400 W from the total input power of 6000 W. Accordingly, the power consumption of the centrifuge motor 9 becomes 3600 W. The control device 20 controls the centrifuge inverter 8 and the compressor inverter 12 via the output control line 27 so that the passing current of the centrifuge motor current sensor 19 becomes 18 A and the rotation number of the compressor motor 13 becomes 58 Hz (which corresponds to 3480 $min^{-1}$ as a result of 58 Hz times 60) during the acceleration of the centrifuge motor 9. After the stabilized acceleration of the rotor 31, the power consumption of the centrifuge motor 9 decreases. Accordingly, an operation control is carried out in such a way that the rotation number of the compressor motor 13 is increased to 65 Hz and the cooling capacity of the rotor 31 becomes strong.

Herein, the power of 2400 W distributed to the compressor motor 13 is a maximum power consumption of the compressor motor 13 when being operated at 58 Hz. The rotation number of 58Hz is the rotation number of the compressor motor 13 capable of preventing the rotor 31 being excessively overheated during the acceleration period thereof. The power consumption of the compressor motor 13 increases as the heat absorption of the evaporator 33 increases.

FIG. 4 illustrates an example of the distribution parameters of the AC source current of the centrifuge 1 according to the present exemplary embodiment. These distribution parameters are stored in a storage means of the control device 20 in the form of a table, for example, in advance. Herein, a combination of each rated supply voltage/rated power supply capacity and the allowable input power and a distribution parameter corresponding to the combination are included in the table. These indicate the factors of the distribution parameter and determined examples as a result of operating the screen of FIG. 3. The setting conditions in FIG. 3 indicate an example of using the rated current of 30 A at the single-phase rated voltage of 200V. In addition to this example, each parameter in a condition for operating the centrifuge under the same noise and cooling condition is stored.

For example, the allowable input power becomes 5040 W when the rated voltage of the AC power supply 22 is 240V and the rated current thereof is 21 A. At this time, the input power of the centrifuge motor 9 is set as 2640 W and the control device 20 outputs a slipping instructions to the centrifuge inverter 8 so that the output of the centrifuge motor current sensor 19 becomes 11.00 A. The term numbers of 1 to 6 in FIG. 4 respectively use the rotor 31 of different family and it is difficult to cool the rotor. Accordingly, the rotation number of the condenser fan 18 is set as 54 Hz.

In a case where the three-phase rated voltage is 400V (in fact, a voltage between each phase is 230V, as mentioned above) and the rated current is set as 15 A/phase (per each one phase) as illustrated in the term number 5, the allowable input power of the centrifuge motor 9 is calculated as 6900 W. However, the input power of the centrifuge motor 9 is determined as 3450 W because the source rated current of the centrifuge motor current sensor 19 is restricted to 15 A. In a case where the rated current is set as 30 A/phase (per each one phase) as illustrated in the term number 6, the allowable input power of the centrifuge motor 9 is calculated as 13800 W. However, the input power of the centrifuge motor 9 is determined as a maximum of 3900 W due to the restriction of the driving torque during acceleration thereof and the source rated current of the centrifuge motor current sensor 19 is restricted to 16.95 A. In this way, the rotation numbers of the centrifuge motor 9 and the compressor motor 13 are preset in accordance with the combination of each rated supply voltage/rated power supply capacity and the allowable input power. Further, the rotation numbers are individually set in during the acceleration of the rotor 31 and after the stabilization thereof.

Of course, it is not necessary that the noise and cooling condition of the centrifuge according to the present invention is limited to the conditions mentioned above. Accordingly, the distribution parameters can be also variously set, regardless of the parameters mentioned above. The centrifuge can be driven in the maximum capacity thereof under various power situations of the AC power supply 22 depending on the setting values.

Meanwhile, when the rotor 31 can be identified, the windage loss, a moment of inertia and a maximum rotation speed (which will be described later) thereof are automatically determined. Accordingly, the identification of the rotor 31 is particularly advantageous for realizing the present exemplary embodiment. Such an identification of the rotor 31 may be automatically acquired by a rotor identification device disclosed in JP-A-H11-156245 or an operator may manually set the rotor 31 from the operating panel 21 to identify the rotor.

Figure 5:
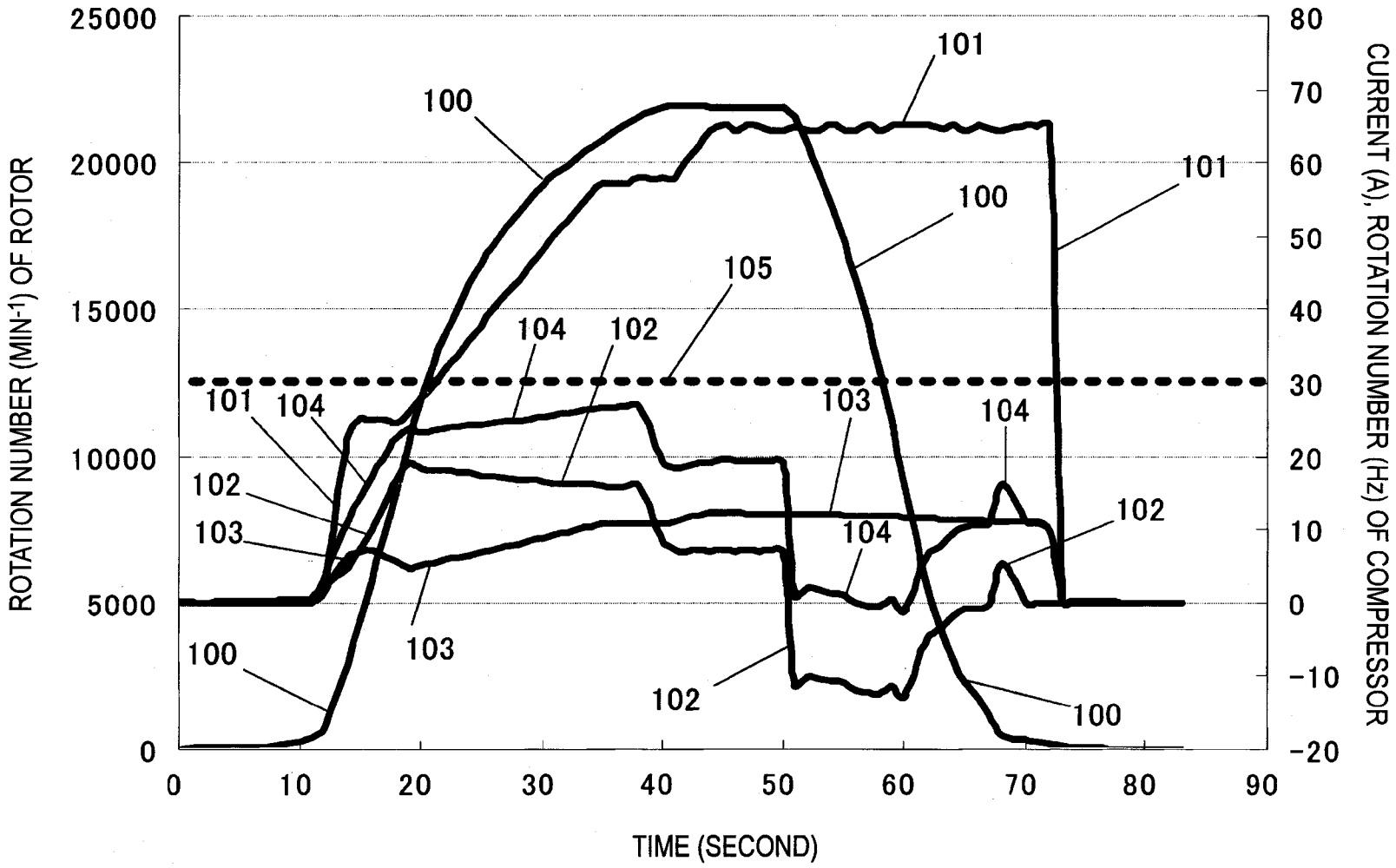
FIG. 5 is a view illustrating an actual measured example of a relationship among the rotation number of the rotor, the rotation number of compressor motor and the current during an acceleration/stabilization/deceleration stop of R22A4 type rotor in the centrifuge according to the exemplary embodiment of the present invention.

FIG. 5 is a view illustrating an actual measured example of an operation in which the control device 20 causes a R22A4 type rotor (which has low moment of inertia and is used in the high-speed refrigerated centrifuge commercially available from the present applicant) to be accelerated at relatively high-speed rotation of a maximum rotation number of 22000 $min^{-1}$ and a moment of inertia of 0.0141 $kg \cdot m^2$, to be stabilized at 22000 $min^{-1}$ and then to be decelerated, depending on the distribution parameters determined as mentioned above.

The rotation numbers of the rotor 31 and the centrifuge motor 9 are represented by reference numeral 100 (left vertical axis: rotation number ($min^{-1}$) scale), the rotation number of the compressor motor 13 is represented by reference numeral 101 (right vertical axis: rotation number (Hz) scale), the output of the centrifuge motor current sensor 19 is represented by reference numeral 102 (right vertical axis: current (A) scale), the output of the compressor motor current sensor 28 is represented by reference numeral 103 (right vertical axis: current (A) scale). Reference numeral 104 represents a total current value (right vertical axis: current (A) scale) of the output of the centrifuge motor current sensor 19 and the output of the compressor motor current sensor 28. In this case, the power consumptions of the condenser fan 18, the DC fan 25 and the DC fan 26 is approximately 100 W in total and therefore the total current value 104 is substantially equal to the current consumption of the entire centrifuge.

Until the R22A4 type rotor 31 reaches a stabilized rotation number of 22000 $min^{-1}$ in about 41 seconds after the start of acceleration thereof as represented by line 100, the rotation number of the compressor motor 13 is controlled to the rotation number of 58 Hz in which the thermal equilibrium state of the cooled rotor 31 is achieved, as represented by line 101 of the rotation number. At this rotation number of 58 Hz, there is no case that the rotor 31 is carelessly warmed during acceleration thereof and also the current consumption of the entire centrifuge which temporarily increases for the acceleration of the rotor 31 can be constantly maintained at a level slightly lower than approximately 30 A, as represented by line 104 of the total current value. Until the R22A4 type rotor 31 reaches a stabilized rotation number of 20000 $min^{-1}$ after the start of acceleration thereof, the control device 20 outputs a slipping instruction to the centrifuge inverter 8 using the output of the centrifuge motor current sensor 19 as a feedback signal so that the passing current of the centrifuge motor current sensor 19 becomes about 18 A and the input power of the centrifuge motor 9 becomes about 3600 W, as represented by line 102. Meanwhile, the control device 20 is operated within the setting rated power capacity of about 6000 W at the current of about 30 A when the input power from the AC power supply 22 is 200V, in conjunction with the maximum input power of the compressor motor 13 of about 12 A and the power consumption of about 2400 W, as represented by line 103. Accordingly, the centrifuge has exhibited its maximum ability.

At this time, a constant current control method for finely controlling the rotation number of the compressor motor 13 may be carried out so that the passing current of the unidirectional converter 5 becomes a constant current. However, according to this method, it is difficult to stabilize the passing current due to a bad response of the rotation number. Rather, it is desirable to maintain the rotation number of the compressor motor 13 in a predetermined rotation number, since a constant current characteristic is excellent and an abnormal noise is also not generated.

After R22A4 type rotor reaches a stabilized rotation number of 22000 $min^{-1}$, the rotation number of the compressor motor 13 is increased to 65 Hz, for example, to strongly cool the rotor 31. The rotation number of 65 Hz is the rotation number of the compressor motor 13 capable of suppressing a noise generated from the compressor 35 below a prescribed noise limit values of the centrifuge, for example, below 58 dB. Consequently, it is possible to suitably suppress a noise from the centrifuge 1.

When the R22A4 type rotor is decelerated and stopped at about 36 seconds from the stabilized state of 22000 $min^{-1}$, the output of the centrifuge motor current sensor 19 during deceleration of the rotor 31 becomes minus values, as represented by line 102. Further, electric energy generated during regenerative braking deceleration of the rotor 31 is absorbed to the Ac power supply 22 by the reverse power flow function of the bidirectional converter 4 or absorbed from the unidirectional converter 5 to the compressor motor 13 via the compressor inverter 12 when the compressor motor 13 is operating, as represented by line 104. Accordingly, in the centrifuge 1 according to the present exemplary embodiment, there is no need to mount so-called regenerative deceleration discharge resistor thereon. Thereby, the centrifuge 1 can be made in a compact manner and thus space-saving can be realized. Further, since the operation and cooling of the rotor can be completely independently controlled in an optimal manner and the receiving power factor is high, it is possible to accelerate or decelerate the rotor in a short time while strongly cooling the rotor 31 rotating at high speed. In this way, the power line harmonics can be reduced. The current is temporarily increased immediately before the stop of the rotor 31, as represented by line 102. This is intended to perform DC braking operation for preventing the centrifuged sample from being scattered using a smoothing deceleration.

Figure 6:
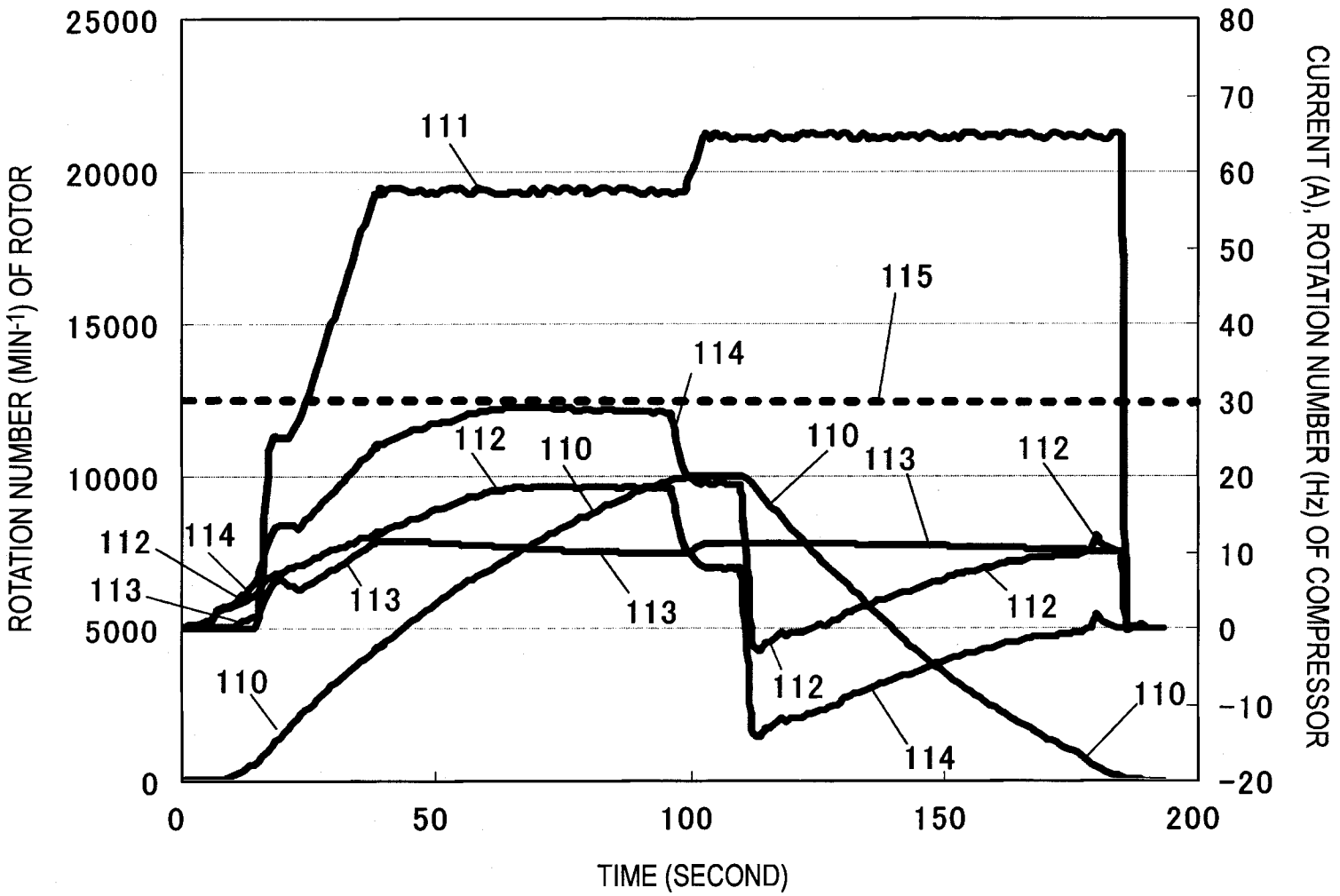
FIG. 6 is a view illustrating an actual measured example of a relationship among the rotation number of the rotor, the rotation number of compressor motor and the current during an acceleration/stabilization/deceleration stop of R10A3 type rotor in the centrifuge according to the exemplary embodiment of the present invention.

Typically, the centrifuge is required to respond to a combination with a rotor having a variety of moment of inertia and maximum rotation number. FIG. 6 illustrates the same characteristics as in FIG. 5, in a case where a R10A3 type rotor (which has high moment of inertia and is used in the high-speed refrigerated centrifuge commercially available from the present applicant) is accelerated for about 100 seconds at relatively low-speed rotation of a maximum rotation number of 10000 $min^{-1}$ and a moment of inertia of 0.277 $kg \cdot m^2$, stabilized at 10000 $min^{-1}$ and then decelerated and stopped in about 90 seconds after the stabilization, using the same control method as in FIG. 5 by the centrifuge according to the present invention. Line 110 (left vertical axis: rotation number ($min^{-1}$) scale) represents the rotation number of the centrifuge motor 9, line 111 (right vertical axis: rotation number (Hz) scale) represents the rotation number of the compressor motor 13, line 112 (right vertical axis: current (A) scale) represents the output of the centrifuge motor current sensor 19, and line 113 (right vertical axis: current (A) scale) represents the output of the compressor motor current sensor 28. Line 114 (right vertical axis: current (A) scale) represents a total current value of the output of the centrifuge motor current sensor 19 and the output of the compressor motor current sensor 28.

It is understood that the control device 20 is operated within the setting rated power capacity of about 6000 W at the current of about 30 A when the input power from the AC power supply 22 is 200V and the centrifuge of the present exemplary embodiment has exhibited its maximum ability, regardless of moment of inertia value of the rotor 31. Next, selection and setting in the control of the rotation number of the condenser fan 18 will be described.

Since the control selection range of the rotation number of the condenser fan 18 is ranged from 0 Hz to 60 Hz and the maximum power consumption thereof is 75 W, the power consumption of entire centrifuge is hardly affected by the power consumption of the condenser fan. However, since the increase in the rotation number significantly affects on the noise, it is necessary to suppress the rotation number of the condenser fan as long as the cooling capacity of the rotor 31 can be secured.

Figure 15:
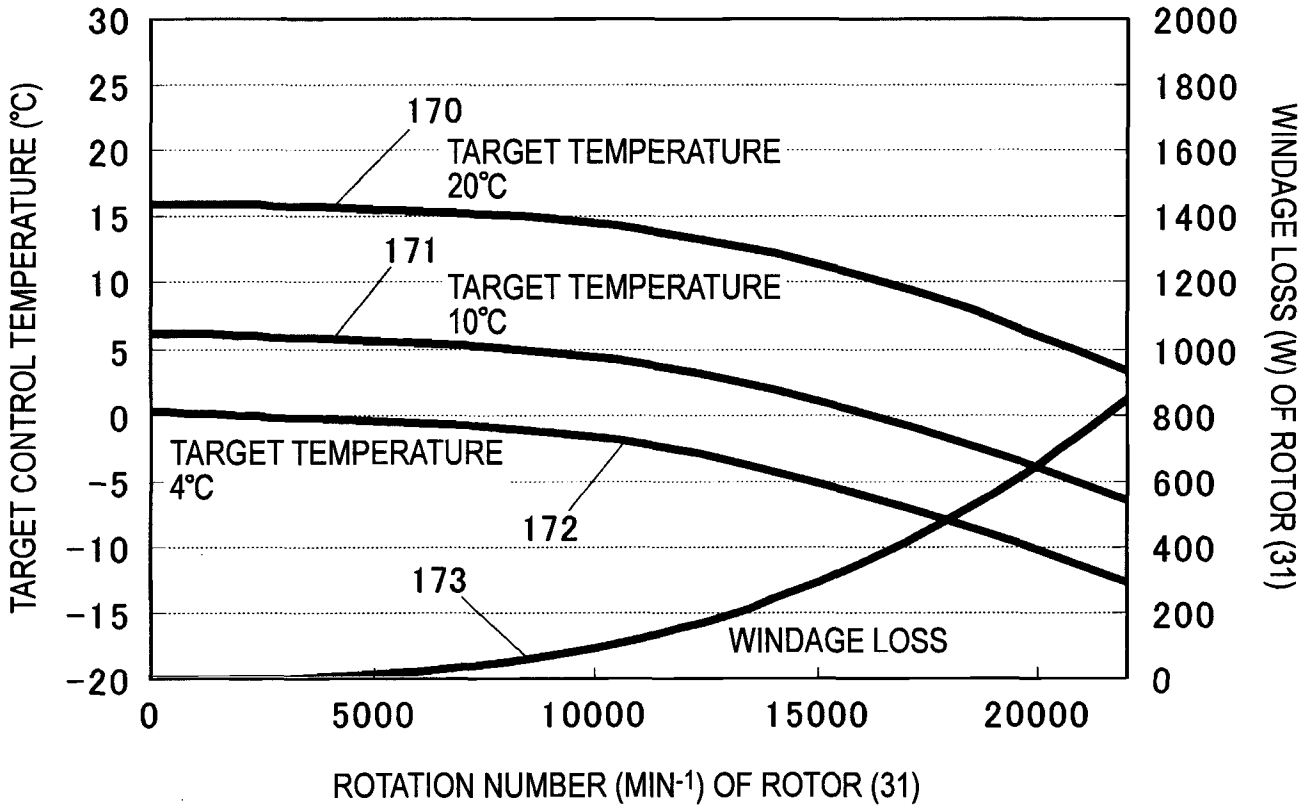
FIG. 15 is a view illustrating a relationship between a target control temperature of the temperature sensor 40*a* and a windage loss of a rotor at respective rotation number of the R22A4 type rotor in the centrifuge.
Figure 16:
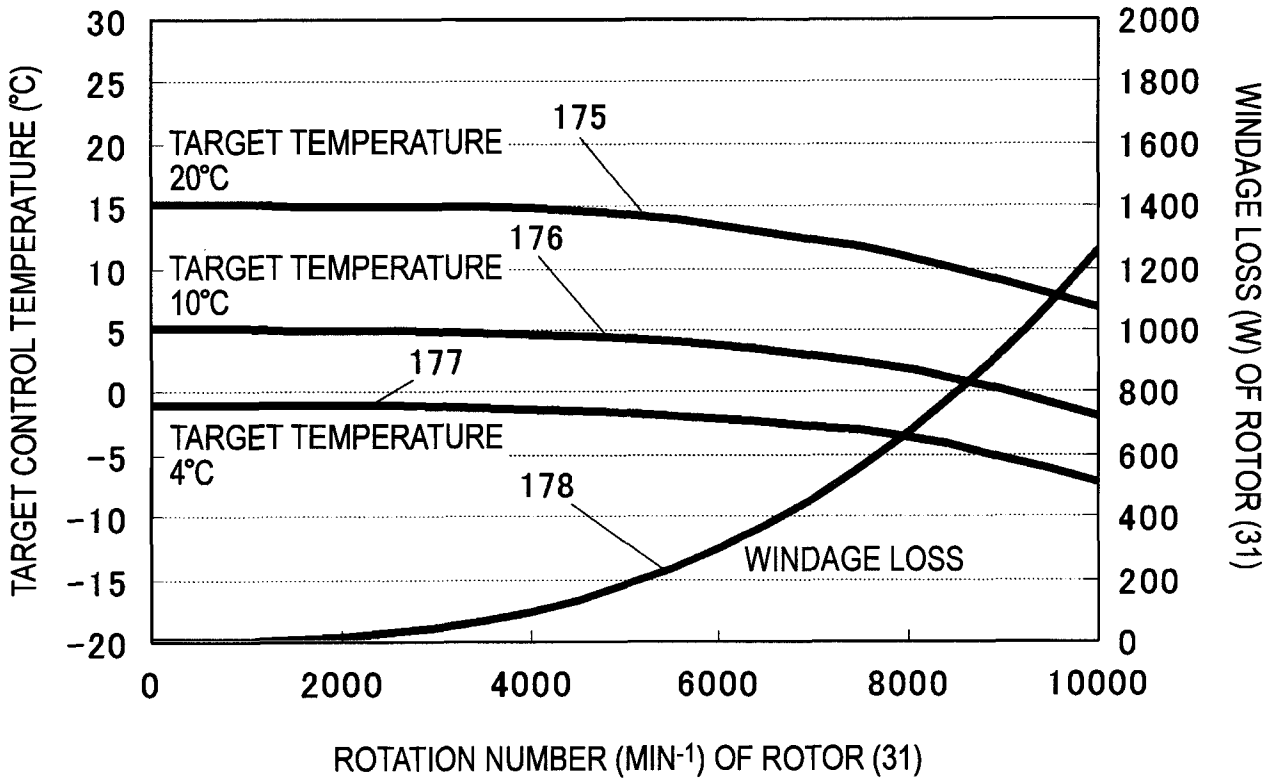
FIG. 16 is a view illustrating a relationship between a target control temperature of the temperature sensor 40*a* and a windage loss of a rotor at respective rotation number of the R10A3 type rotor in the centrifuge.

FIG. 15 is a graph illustrating the magnitude of a target control temperature and a windage loss of R22A4 type rotor. FIG. 16 is a graph illustrating the magnitude of a target control temperature and a windage loss of R10A3 type rotor. In FIG. 15, lines 170 to 172 represent target control temperatures of the R22A4 type rotor when being cooled to respective preset temperature and line 173 represents the relationship between the magnitudes of the rotation number and the windage loss of the rotor 31. Herein, the difference of the target control temperature in accordance with the difference of the rotor 31 will be explained when the target control temperature is at 4° C. As is apparent from the comparison between lines 170 and 173 of FIG. 15 and lines 175 and 178 of FIG. 16, the R22A4 type small-capacity high-speed rotation rotor has a small surface area and heat sources of windage loss thereof are concentrated. Accordingly, a large cooling capacity is required even though the windage loss is small. In contrast, the R10A3 type large-capacity low-speed rotation rotor has a large surface area and heat sources of windage loss thereof are widely spread. Accordingly, only a small cooling capacity is sufficient even though the windage loss is large.

Figures 17, 18:
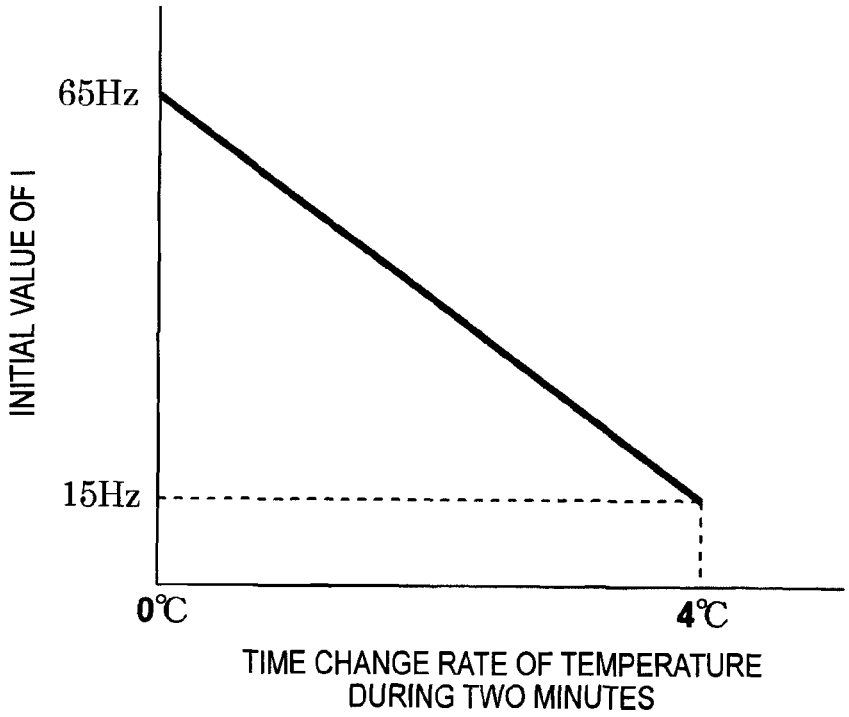
FIG. 17 is a view illustrating a relationship between an initial value of I (integration term) and a temperature-time change rate (° C./sec) in which a measured temperature value of the temperature sensor 40*a* is reduced during two minutes immediately before migration to PID control.
FIG. 18 is a table illustrating an example of some combinations of the relationship between the type of a rotor 31 and the rotation number of a condenser fan 18 used in the centrifuge.

More generally, in large-capacity rotor, a cover member for covering the outer surface of the rotor is required in order to reduce the windage loss and a great wind noise tends to occur due to the deformation of the cover member during rotation of the rotor. From the relationship between the required cooling capacity of the rotor and the noise occurred while considering above factors, the upper limit of the rotation number of the condenser fan 18 is automatically selected and set in accordance with the type of the rotor 31 used in the centrifuge, as illustrated in FIG. 18. Meanwhile, the R15A type rotor in FIG. 18 is a rotor (which is used in the high-speed refrigerated centrifuge commercially available from the present applicant and has medium moment of inertia) that rotates at relatively low-speed rotation of a maximum rotation number of 15000 $min^{-1}$ and a moment of inertia of 0.1247 $kg \cdot m^2$.

Of course, the preset rotation number of the condenser fan 18 significantly affecting on the cooling capacity and the noise may be added to the factors for determining the distribution parameters mentioned above. Alternatively, the rotation number of the condenser fan 18 may be suitably changed by considering the relationship between the required cooling capacity and the rotation number of the compressor motor 13 or the rotation number of the centrifuge motor 9.

Hereinabove, since the configuration of the centrifuge 1 according to the present exemplary embodiment does not depend on the supply voltage, there is no need an autotransformer. Further, there is no need to switch a tap matching to the voltage of the destination. In this way, a compact product can be made and thus productivity is improved. Further, since the configuration of the centrifuge does not depend on the supply frequency and the compressor motor and the condenser fan as major noise sources are operated at a suitable rotation number using variable speed control, the centrifuge having excellent sound insulating properties and noise barrier performance can be realized. Further, since the current of the rotor during acceleration is set and stored to be adjusted in accordance with the power supply capacity of the destination and the centrifuge is controlled to operate at substantially maximum power supply current value based on the adjusted contents, the maximum performance can be always realized in accordance with the power conditions.

<Exemplary Embodiment 2>

Next, a control for changing the distribution ratio of the power to the centrifuge motor 9 and the compressor motor 13 in accordance with the type of the rotor 31 mounted will be described by referring to FIG. 7. As illustrated in FIG. 7, the type of the rotor 31 and the distribution parameters are stored in a storage device in advance in the form of a table. The control device 20 identifies the type of the rotor 31 mounted and controls the power supply to the centrifuge inverter 8 and the compressor inverter 12 in accordance with the distribution parameters read out from the storage device.

As an example, the control device 20 is operated within the setting rated power capacity of about 6000 W at the current of about 30 A when the input power from the AC power supply 22 is 200V. In R22A4 type small-capacity high-speed rotation rotor of term number 1, since the acceleration time is short but large cooling capacity is required, the power of the centrifuge motor 9 during acceleration is restricted to approximately 3350 W. Meanwhile, the rotation number of the compressor motor 13 is made to a high-speed of 64 Hz to secure sufficient cooling capacity.

In R10A3 type large-capacity low-speed rotation rotor of term number 3, since the acceleration time is long but large cooling capacity is not required, the power supply distributed to the centrifuge motor 9 is increased to approximately 3900 W to shorten the acceleration time, during the acceleration thereof. Meanwhile, the rotation number of the compressor motor 13 is made to a low-speed of 50 Hz to reduce the cooling capacity. Since the rotor of term number 2 is R15A type medium-capacity medium-speed rotation rotor, the rotation number of the compressor motor 13 and the power of the centrifuge motor 9 during acceleration are determined in the middle of term number 1 and 3. Meanwhile, in a case of other power condition where the rated voltage and rated current of the AC power supply 52 are changed, it is preferable that the distribution parameters are determined in advance based on the above ideas and stored in the storage device.

In this way, the distribution parameters are set and stored so that the rotation number of the compressor motor 13 and the power of the centrifuge motor 9 during acceleration can be suitably distributed to match the acceleration time and cooling property of the rotor 31 in accordance with the power supply capacity of the destinations and the type of the rotor 31 mounted. Further, since the centrifuge is controlled to determine the distribution ratio of the power to the centrifuge motor 9 and other motors based on the above contents, the optimal performance can be always realized in accordance with the power conditions.

<Exemplary Embodiment 3>

Figure 8:
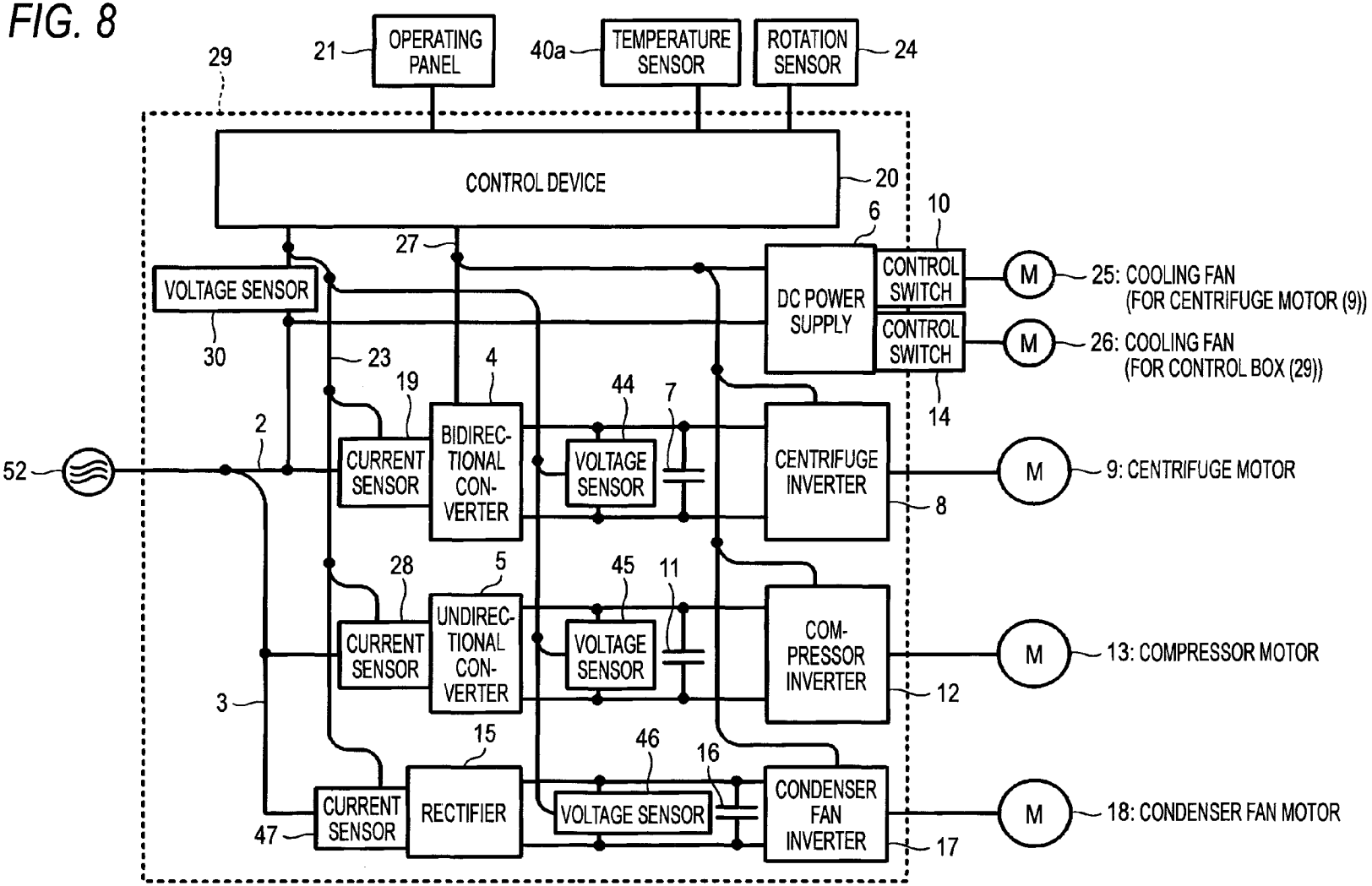
FIG. 8 is a block diagram illustrating the centrifuge according to a third exemplary embodiment of the present invention, in a state of being connected to a three-phase AC power supply.

Next, a third exemplary embodiment of the present invention will be described by referring to FIG. 8. By referring to the block diagram of the centrifuge of FIG. 8, the third exemplary embodiment is different from the first exemplary embodiment of FIG. 1 in that a three-phase AC power supply is used as a power supply and the power supply line 2 and the power supply line 3 are connected to a different phase of the AC power supply 52. Other parts with same reference numerals are the same as in the block diagram of the first exemplary embodiment illustrated in FIG. 1.

When the centrifuge controls the rotor 31 to be stabilized in a predetermined rotation number, the power consumption becomes larger in a case of cooling and keeping the rotor at a temperature of 4° C., for example. In a case of the centrifuge in which the rotor 31 is rotated in the atmosphere, a normal power consumed at the centrifuge motor 9 is substantially same as the power consumed at the compressor motor 13 and becomes approximately 1 kW to 2 kW. In this case, a value obtained by multiplying a conversion efficiency of the powers into the driving force to these powers is equal to the windage loss of the rotor 31. Meanwhile, since both the power consumption of the DC power supply 6 and the power consumption of the condenser fan 18 are approximately 50 W to 100 W, the power consumptions of the supply line 2 and the supply line 3 are substantially same. When these supply lines are connected to different phase of three-phase alternating current of the AC power supply 52, the power consumptions are balanced without being biased. The method for connecting the supply line 2 and the supply line 3 to the AC power supply 22 as illustrated in FIG. 1 is a versatile connection method since it is very easy to separate the connection therebetween and reconnect as illustrated in FIG. 8 or vice versa.

In the centrifuge according to the third exemplary embodiment, the bidirectional converter 4 as a converter of the large-capacity centrifuge motor 9 enhances the power factor of the AC power supply 22 and is boost controlled to be a DC voltage obtained by adding about 10V to the peak voltage of 264V power supply voltage. Since the DC output voltage charged into the smoothing condenser 7 is controlled to a constant voltage of about 385V, the inverter circuit of the centrifuge motor 9 can be stably controlled in response to the fluctuation of the supply voltage of the AC power supply 22. Similarly, the compressor motor 13 has a large capacity. The unidirectional converter 5 supplies power to the compressor motor 13 and can respond to 170V to 264V supply voltage fluctuation or the supply frequency change of between 50 Hz and 60 Hz. Accordingly, the compressor motor 13 is also controlled in a stable manner.

Of course, the ability to cool a chamber 32 depends on the rotation number of the compressor motor 13 of the compressor 35. In addition, the ability is greatly influenced by the air volume of the condenser fan 18 cooling the condenser 37. In particular, there is a problem that the noise and maximum cooling capacity of the centrifuge are changed in accordance with the supply frequency environment of 50 Hz and 60 Hz to be used. For example, in AC fan type condenser fan 18, the air volume per hour is 1800 m3 and the noise level is approximately 50.6 dB in the power frequency of 50 Hz, while the air volume per hour is 2040 m3 and the noise level is approximately 54.3 dB in the power frequency of 60 Hz. That is, the air volume increases by approximately dozen % but the noise level also rises by approximately 3 to 4 dB in the power frequency of 60 Hz.

Similarly, in the case of AC fan cooling the centrifuge motor 9 or the control box 29, the air volume and the noise level in the power frequency of 60 Hz are larger than in the power frequency of 50 Hz. In this way, the ability to cool the chamber 32 becomes larger in the condenser fan 18 having the power frequency of 60 Hz, as compared to the power frequency of 50 Hz. Accordingly, in the power frequency of 50 Hz, the maximum cooling ability of the rotation chamber 48 of the centrifuge is small and the noise level thereof is also small. In contrast, in the power frequency of 50 Hz, the maximum cooling ability of the rotation chamber 48 of the centrifuge is large but the noise level thereof is also large. The DC voltage of the DC power supply 6 is, for example, 24V and DC 24V is supplied even though the supply voltage varies in a range of 170 V to 264V. Accordingly, the DC fan 25 and the DC fan 26 are maintained in a constant rotation number and the air volume and the wind pressure does not change. In this way, it is possible to cool the centrifuge motor 9 or the control box 29 without depending on the supply voltage and the power frequency and without change in the noise level.

As mentioned above, in the third exemplary embodiment, the centrifuge is operated in such a way that the supply voltage and the power frequency are freely selected and the distribution parameters are determined by stored setting results of the connected supply voltage and the allowable rate current. Accordingly, it is not necessary to prepare the autotransformer even though the voltage of AC power supply connected is variously changed and it is possible to eliminate the difference in the cooling ability and the noise level due to the difference of the power frequency of 50 Hz and 60 Hz. As a result, the centrifuge having optimal maximum cooling ability and noise barrier performance can be realized. Further, not only connection to the single-phase AC power supply and but also connection to the multi-phase power supply can be easily changed. At this time, the multi-phase power supply causes the bidirectional converter 4 of the centrifuge motor 9 and the unidirectional converter 5 of the compressor 13 to be powered by different phases. Accordingly, the current amount used per respective phase can be reduced. As result, the operation of the centrifuge becomes possible, even though the source impedance of the AC power supply is high.

<Exemplary Embodiment 4>

Next, an operation for controlling the temperature of the rotor 31 of the centrifuge 1 will be described. In this operation, the temperature of the rotor 31 is rapidly approached to a target preset temperature regardless of the magnitude of the windage loss of the rotor 31 and then the temperature of the rotor is controlled with a high precision.

In a related-art temperature control method, since the temperature of the chamber 32 is detected by the temperature sensor **40*b* and the compressor motor 13 is subjected to an intermittent control (ON-OFF control), the overshoot and undershoot are repeatedly generated when the temperature of the sample in the rotor 31 is controlled to a desired target temperature and thus the pulsation to the surface temperature of the rotor 31 side of the chamber 32 occurs. Meanwhile, a temperature correction value is calculated in advance by an experiment, etc., and corresponds to the difference between the target temperature (target control temperature) of the temperature sensor 40*b* during the rotation of the rotor 31 and the temperature of the sample in the rotor 31. In order to compensate for errors occurring in such a temperature control, the temperature correction value is utilized to realize high precision. However, in ON-OFF control of a related-art compressor 35, the noise generated during ON-OFF switching and the instantaneous voltage drop of the AC power supply 22 are accompanied and, in addition to this, the temperature of the rotor 31 is controlled while the temperature in the chamber 32 is being pulsated. Accordingly, further high-precision temperature control for overcoming the temperature fluctuation width was a challenge for many years. As a means for detecting the temperature of the rotor 31, a radiation thermometer is provided in the rotation chamber 48 of the rotor 31. The radiation thermometer is configured to directly measure the temperature of the bottom surface of the rotor 31. The temperature thus measured is used as the target control temperature to control and maintain the rotor 31 at a desired temperature. However, in the exemplary embodiment of the present invention, a method indirectly measuring the temperature of the chamber 32 by the temperature sensors 40*a*, 40*b*** such as a thermistor will be described below.

In the temperature correction value, the occurring amount due to the windage loss and the amount of heat exchange between the chamber 32 and the rotor 31 are changed depending on the type/shape of the rotor, in addition to the operating rotation number of the rotor 31 and the maintaining temperature of the sample. Accordingly, the temperature correction value is determined in advance in accordance with the type of the rotor/the operating rotation number of the rotor/the maintaining temperature of the sample and stored in the operating panel 21 or the control device 20. Further, the temperature correction value which was in the operation and temperature control condition other than the type of the rotor 31 is utilized in order to improve the accuracy of the temperature control.

Recently, in consumer equipments such as an air conditioner or a refrigerator, a technology in which the compressor motor 13 of a cooling machine is driven by the compressor inverter 12 in a variable-speed has been widely developed and considered to be applied in the field of the centrifuge. However, in the centrifuge, the maintaining temperature of the sample is in a wide range from −20° C. to 40° C. and the windage loss is largely varied in a range from several hundreds of W to 2 kW depending on the rotation number or the type of the rotor. For this reason, a temperature control technology completely different from the consumer equipments is required in a case of being applied to an inverter type cooling machine. Now, the type, a relationship among the rotation number and the windage loss of the rotor will be described by referring to FIG. 15 and FIG. 16. FIG. 15 is a view illustrating a relationship between the target control temperature of the temperature sensor 40*a* and the windage loss of the rotor at respective rotation number of the R20A4 type rotor in the centrifuge commercially available from Hitachi Koki Co., Ltd. Horizontal axis indicates the rotation number ($min^{-1}$) of the rotor 31. Herein, the windage loss (unit: W) 173 of the rotor 31 corresponds to the right vertical axis and the windage loss of the rotor 31 is substantially proportional to the rotation number thereof. The windage loss of the rotor is proportional to nearly 2.8 square of the rotation number of the rotor 31 in an approximation expression.

Even if the inverter type cooling machine is employed and a so-called temperature feedback PID control method is employed, the amount of heat generation of the rotor is greatly varied depending on the operating conditions, as mentioned above. Herein, the temperature feedback PID control method includes a proportional term, an integration term and a differential term and uses the difference between the detected temperature of the temperature sensor 10*a* and setting target temperature. The relationship between the rotation number and the target control temperature of the rotor 31 is indicated by 170 to 172. Herein, 170 indicates a curve of target control temperature in a case of cooling the rotor 31 to 20° C., 171 indicates a curve of target control temperature in a case of cooling the rotor to 10° C. and 172 indicates a curve of target control temperature in a case of cooling the rotor to 4° C. As is apparent from the curves 170 to 172, the windage loss of the rotor increases as the rotation number of the rotor 31 rises and thus it is desirable to set the target control temperature to a small value. As such, PID control parameters distributed to the proportional term, the integration term and the differential term have optimal values which are greatly varied depending on the temperature control conditions. Accordingly, it is difficult to uniformly determine a proper value of the PID control parameters. For this reason, hunting of the control temperature is likely to occur when only PID control for the rotation number of the compressor motor 13 is performed and thus further improvements in the accuracy of control temperature cannot be expected. Accordingly, it is required to improve the temperature control accuracy by suppressing an undesirable temperature difference between the upper and lower rotor temperature.

Accordingly, in the fourth exemplary embodiment, the control device 20 feedbacks the detected temperature of the temperature sensor 40*a* provided on the bottom of the chamber 32 and controls the rotation number of the compressor motor 13 in the compressor 35 so as to allow the sample in the rotor 31 to be a setting target temperature. The rotation number of the condenser fan 18 configured to send wind for heat dissipation of the condenser 37 is controlled to 50 Hz as mentioned above.

FIG. 16 is a view illustrating a relationship between the target control temperature of the temperature sensor 40*a* and the windage loss of the rotor at respective rotation number of the R10A3 type rotor commercially available from the present applicant. The R10A3 type rotor is large and a rotor diameter thereof is large, as compared to the R20A4 type rotor. Accordingly, the degree rise of the windage loss (unit: W) 178 of the rotor 31 due to the rise of the rotation number becomes larger than the windage loss 173 of FIG. 15. However, since the surface area of the R10A3 type rotor is larger than that of the R20A4 type rotor, cooling effect thereof is superior to the R20A4 type rotor owing to cooling of the chamber 32. Accordingly, the relationship between the rotation number and the target control temperature of the rotor 31 is indicated by 175 to 177. Herein, 175 indicates a curve of target control temperature in a case of cooling the rotor 31 to 20° C., 176 indicates a curve of target control temperature in a case of cooling the rotor to 10° C. and 177 indicates a curve of target control temperature in a case of cooling the rotor to 4° C. As is apparent from the curves 175 to 177 of target control temperature, the windage loss of the rotor increases as the rotation number of the rotor rises and thus the target control temperature is set to a small value.

Figure 9:
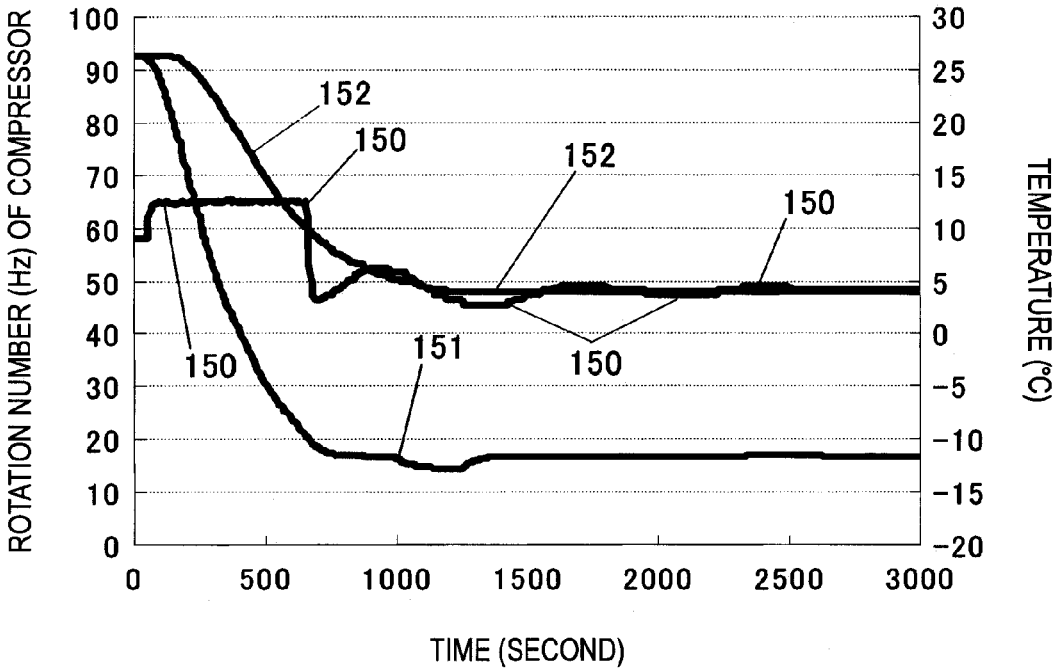
FIG. 9 is a view illustrating an actual measured example of a centrifuge according to a fourth exemplary embodiment of the present invention, in a case where R22A4 type rotor is rotated at rotation number of 22000 $min^{-1}$ and a temperature sensor 40*a* is utilized in the control of cooling and maintaining the temperature of a sample at 4° C.

FIG. 9 illustrates the rotation number (unit: Hz) 150 of the compressor motor 13, the measured temperature (unit: ° C.) 151 of the temperature sensor 40*a* and the bottom temperature (unit: ° C.) 152 of the rotor 31 when the R22A4 type rotor as the rotor 31 is rotated in a rotation number of 22000 $min^{-1}$ and the temperature of the sample is controlled to 4° C. in the centrifuge 1 according to the present exemplary embodiment. Horizontal axis thereof indicates lapse time after the rotation of the rotor 31.

In this rotor, the target control temperature for cooling the rotor 31 rotating in the rotation number of 22000 $min^{-1}$ to 4° C. is set as −12.7° C., as illustrated by line 172 of FIG. 15. The control rotation number of the compressor motor 13 at this time is set as 58 Hz in the acceleration stage of the rotor 31 and set as 65 Hz after the rotor 31 is stabilized at the rotation number of 22000 $min^{-1}$, as indicated in the vicinity of 0 to 500 seconds of FIG. 9. By controlling in this way, the detected temperature of the temperature sensor 40*a* is dropped over time and reaches −12.2° C. in the vicinity of 650 seconds, which is higher than the target control temperature by 0.5° C. In this way, the rotation number of the compressor motor 13 is controlled by a feedback control using the detected temperature of the temperature sensor 40*a* and the target control temperature. Initial value of I (integration term) at the start of the PID control of FIG. 17 can be determined by a temperature-time change rate (° C./sec) in which an measured temperature value of the temperature sensor 40*a* is reduced during two minutes immediate before migration to PID control, for example.

Next, PID control as an example of the feedback control will be described by referring to FIG. 17. Initial value of I (integration term) at the start of the PID control can be determined by a temperature-time change rate (° C./sec) in which an measured temperature value of the temperature sensor 40*a* is reduced during two minutes immediate before migration to PID control, for example. For example, since the temperature-time change rate (° C./sec) is approximately 1.2° C. for two minutes in FIG. 17, 50 Hz is supplied as an initial value of I term at the PID control. Herein, the sum of P, I and D at the PID control is used as a compressor frequency. In this case, although new values are determined as P and D at each operation, I is integrated along the time axis and therefore. Accordingly, an effect such as a control offset at a later is exhibited if I is supplied as an initial value in advance. By these control operations, the rotation number of the compressor motor 13 during migration to PID control is maintained at a high level and the temperature of the temperature sensor 40*a* approaches to the control target temperature in a rapid and smooth manner. The reason is that the cooling speed of the rotor 31 becomes faster and thus I during migration to PID control is set to a small value in a case where the temperature-time change rate becomes larger and I during migration to PID control is set to a large value in a case where the temperature-time change rate becomes smaller. In this way, it is possible to give an inflection point in the control of the rotation number of the compressor motor 13, thereby rapidly approaching the temperature of the temperature sensor 40*a* to the control target temperature, in both cases.

By these control operations, the calculated rotation number of the compressor motor 13 obtained by PID calculation is finally stabilized to the rotation number of approximately 48 Hz although several overshoot/undershoot of the rotation number is essentially involved. Thereafter, the rotation number of the compressor motor is stably controlled. During this time, the bottom temperature 152 of the rotor 31 which is substantially equal to the temperature of the sample of the rotor 31 is smoothly dropped from 26° C. at the start of the control over time and maintained exactly at 4° C.

Figure 10:
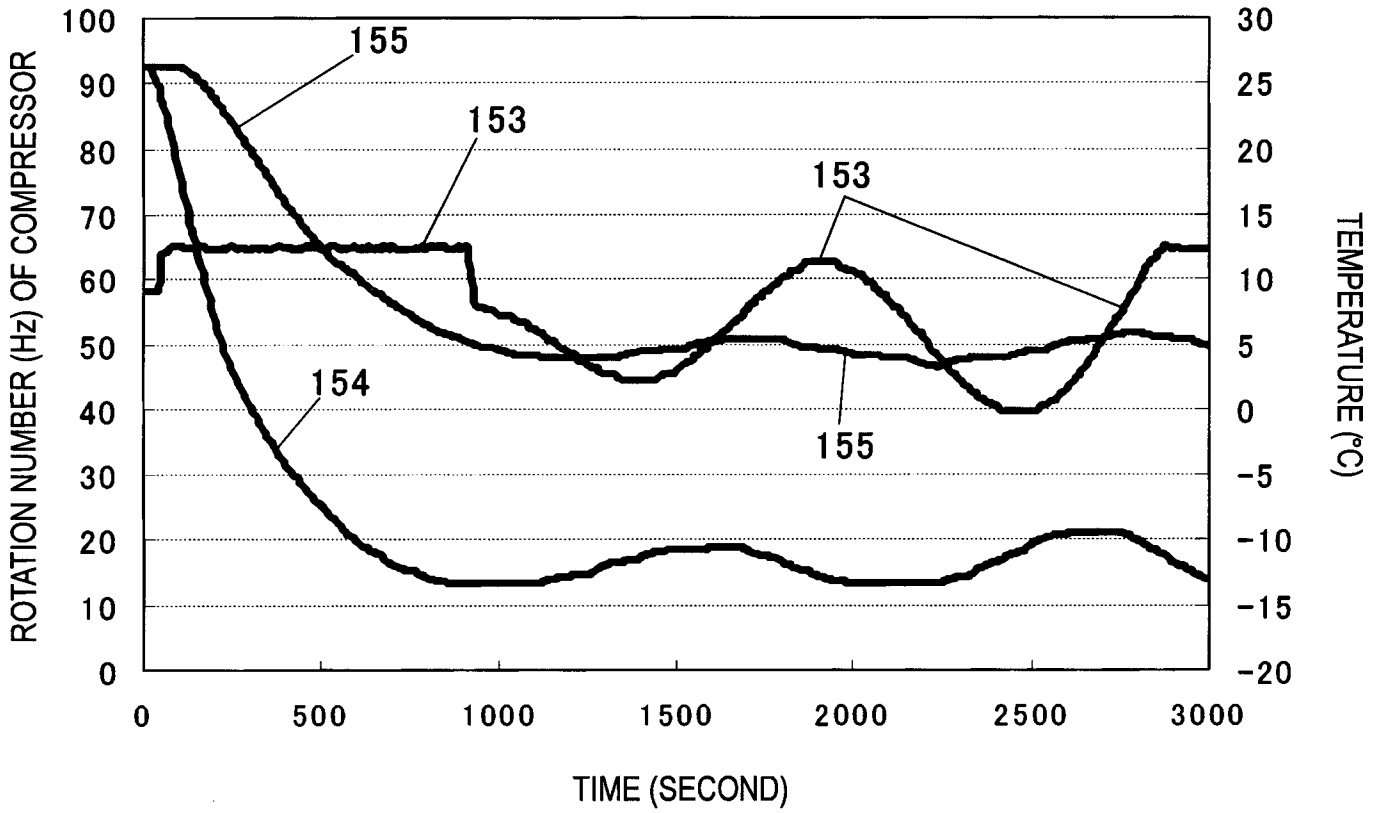
FIG. 10 is a view illustrating an actual measured example of a centrifuge according to the fourth exemplary embodiment of the present invention, in a case where R22A4 type rotor is rotated at rotation number of 22000 $min^{-1}$ and a temperature sensor 40*b* is utilized in the control of cooling and maintaining the temperature of a sample at 4° C.

FIG. 10 illustrates a relationship among the rotation number (unit: Hz) 153 of the compressor motor 13, the bottom temperature (unit: ° C.) 155 of the rotor 31 and the measured temperature (unit: ° C.) 154 of a temperature sensor 40*b* over time when the R22A4 type rotor is rotated in a rotation number of 22000 $min^{-1}$ and the temperature of the sample is cooled to 4° C. in a related-art centrifuge. Unlike the present exemplary embodiment of FIG. 9, the temperature sensor 40*b* provided in the seal rubber 41 is used to carry out the temperature control in the related-art centrifuge, instead of the temperature sensor 40*a*. This example is the same as the actual measured example illustrated in FIG. 9, except that the cooling target temperature of the temperature sensor 40*b* is changed from −12.7° C. of FIG. 9 from −7° C. owing to the difference of the temperature control target.

As is apparent from FIG. 10, since the control rotation number of the related-art compressor motor 13 is not stably converged over time due to the repetition of overshoot and undershoot, the noise occurred from the compressor motor 13 is fluctuated and the bottom temperature of the rotor 31 is continuously pulsated and thus the temperature control accuracy is degraded. The reason is that the response property such as the time lag in the temperature change of the evaporator 33 and the time constant relative to the change of the rotation number of the compressor motor 13 is poor because the temperature sensor 40*b* is covered with the seal rubber 41. Accordingly, it is desirable to use the temperature sensor 40*a* illustrated in FIG. 9 in order to carry out the temperature control according to the present exemplary embodiment, instead of using the temperature sensor 40*b* illustrated in FIG. 10. The reason is that the response property relative to the temperature change of the evaporator 33 is good because the temperature sensor 40*a* is provided in contact with the metal part of the chamber 32.

Figure 11:
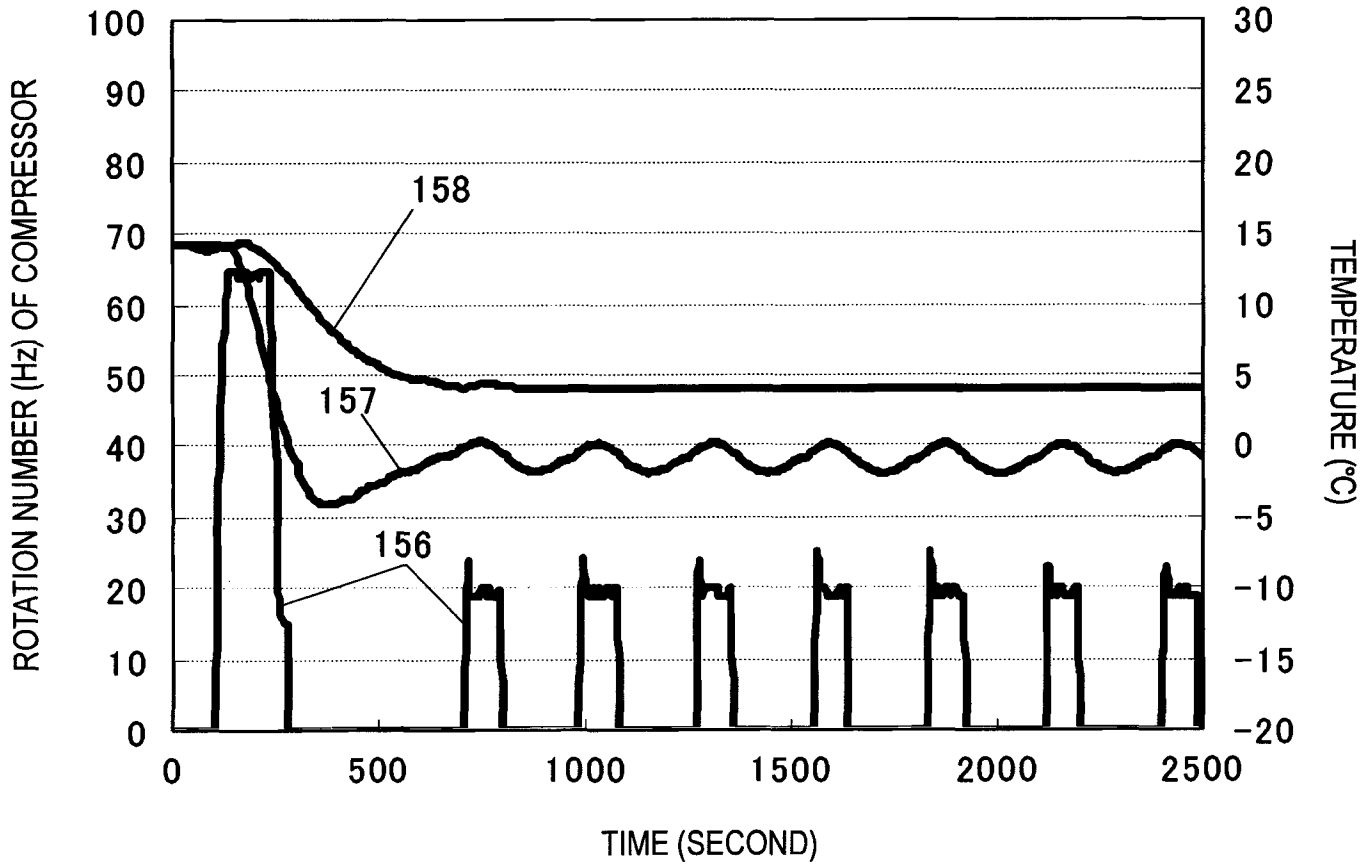
FIG. 11 is a view illustrating an actual measured example of a centrifuge according to the fourth exemplary embodiment of the present invention, in the control of rotating R22A4 type rotor at rotation number of 10000 $min^{-1}$ and cooling and maintaining the temperature of a sample at 4° C.

FIG. 11 illustrates a relationship among the rotation number (unit: Hz) 156 of the compressor motor 13, the measured temperature (unit: ° C.) 157 of the temperature sensor 40*a* and the bottom temperature (unit: ° C.) 158 of the rotor 31 over time when the R22A4 type rotor as the rotor 31 is rotated in a rotation number of 10000 $min^{-1}$ and the temperature of the sample in the rotor 31 is controlled to 4° C. in the centrifuge 1. The bottom temperature of the rotor is substantially equal to the temperature of the sample of the rotor 31. Under this condition, the windage loss of the rotor 31 corresponds to 11% of a case explained in FIG. 9 and is less than 100 W. When the rotation number 156 corresponding to the measured temperature 157 is less than the minimum rotation number (for example, 15 Hz in the present exemplary embodiment) in accordance with the temperature control operations, the rotation number control of the compressor motor 13 is switched from PID continuous rotation number control to ON state of 20 Hz and OFF state. Normally, in the compressor motor 13, a maximum rotation number (maximum continuous rotation number) and a minimum rotation number (minimum continuous rotation number) which can be continuously performed are set in consideration of the relationship between rated voltage and stability. Herein, the continuous rotation number during intermittent control is set as 20 Hz which is higher than the minimum continuous rotation number of the compressor motor 13. In the present invention, respective rotation number of the compressor motor 13 during ON-OFF control, that is, a start-stop rotation number is 20 Hz in ON state and 0 (zero) Hz in OFF state.

Since the minimum rotation number which can be continuously performed are set as 15 Hz which is lower than the rotation number (20 Hz) during ON time in the ON-OFF control, it is possible to achieve an excellent temperature control property, even when the range of heat absorption between the minimum continuous rotation number control and the ON-OFF intermittent control is overlapped and the control state is switched between the continuous rotation number control at a lower speed and the ON-OFF intermittent control. Although the measured temperature 157 of the temperature sensor 40*a* is slightly pulsated in accordance with the repetitive controls of ON and OFF states of the compressor motor 13, it is understood that the bottom temperature 158 of the rotor 31 is not changed and thus the temperature control can be carried out in a stable and accuracy manner.

The target control temperature of the temperature sensor 40*a* is approximately −1° C. and the rotation number of the compressor motor 13 is initially 65 Hz in the vicinity of the 100 seconds to 300 seconds at the start of the temperature control. When the temperature of the temperature sensor 40*a* is changed to −0.5° C. by the PID control, the rotation number is controlled to be continuously lowered. However, since the measured temperature 157 of the temperature sensor 40*a* is further dropped when the compressor motor 13 is continuously operated even at a minimum continuous rotation number of 15 Hz, the compressor motor 13 is turned off when the target control temperature is dropped to −3° C. lower than approximately −1° C. by −2° C. and ON-OFF control of the compressor motor 13 is performed. Furthermore, when the measured temperature 157 of the temperature sensor 40*a* is switched to rise and becomes 0° C. higher than the target control temperature by 1° C., the compressor motor 13 is turned on again. In this ON-OFF control, OFF state is switched to ON state when the measured temperature is higher than the target control temperature by +1° C. whereas ON state is switched to OFF state when the measured temperature is lower than the target control temperature −1° C. OFF state is ensured for minimum of 60 seconds (minimum OFF time) when OFF state is switched to ON state and ON state whereas ON state is ensured for minimum of 30 seconds (minimum ON time) when ON state is switched to OFF state. The reason is that ON state is required when the pressure difference between the suction pipe 42 and the discharge pipe 36 is smaller than a predetermined value and OFF state is required when the pressure difference is larger than the predetermined value, in consideration of oil lubrication of the compressor 35.

Figure 12:
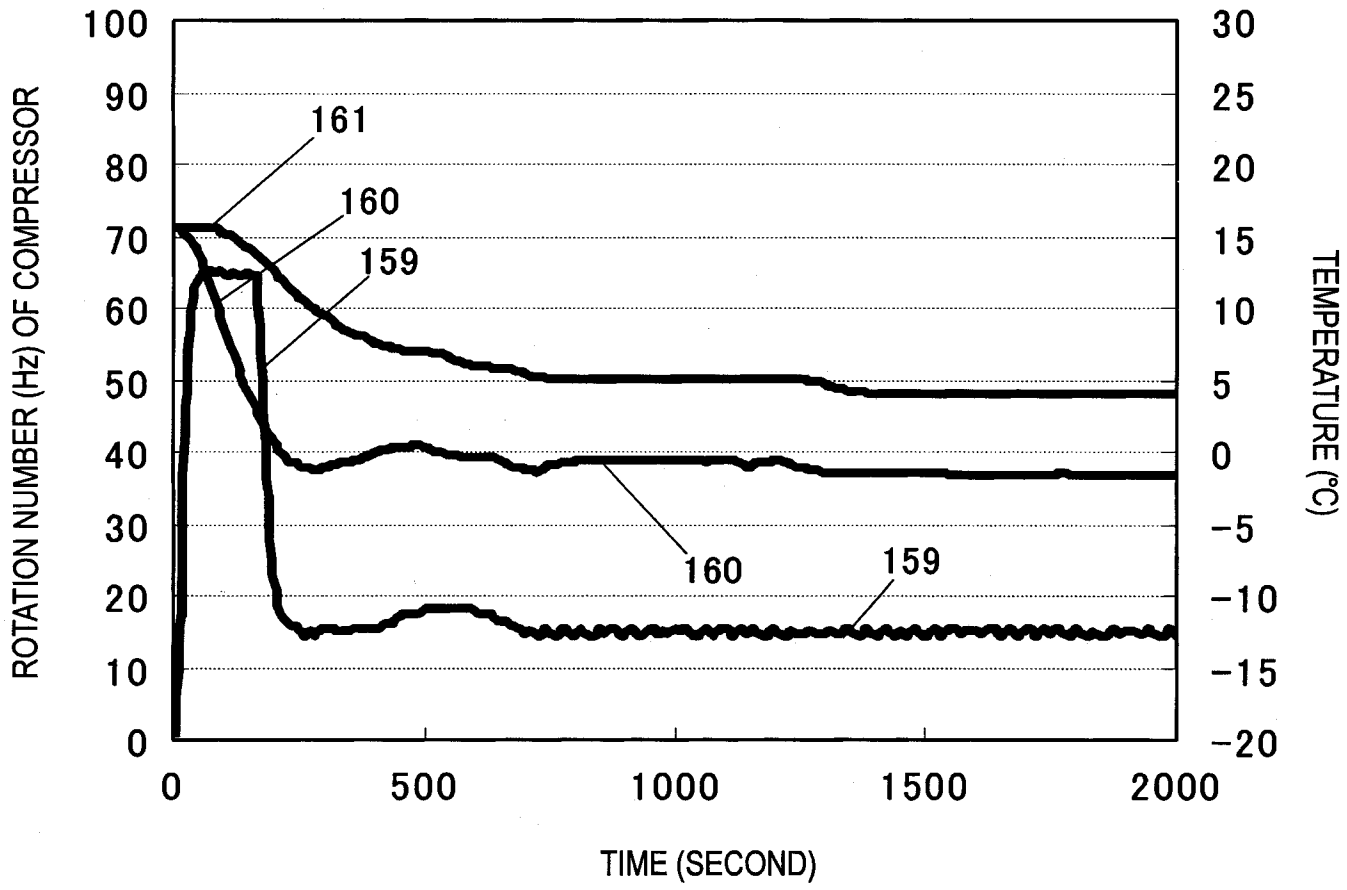
FIG. 12 is a view illustrating an actual measured example of a centrifuge according to the fourth exemplary embodiment of the present invention, in the control of rotating R10A3 type rotor at rotation number of 7800 $min^{-1}$ and cooling and maintaining the temperature of a sample at 4° C.

FIG. 12 illustrates a relationship among the rotation number (unit: Hz) 159 of the compressor motor 13, the measured temperature (unit: ° C.) 160 of the temperature sensor 40*a* and the bottom temperature (unit: ° C.) 161 of the rotor 31 over time when the R10A3 type rotor as the rotor 31 is rotated in a rotation number of 7800 $min^{-1}$ and the temperature of the sample in the rotor 31 is controlled to 4° C. in the centrifuge 1. The bottom temperature of the rotor is substantially equal to the temperature of the sample of the rotor 31. The target temperature of the control temperature sensor 40*a* is approximately −2° C. Under this condition, the windage loss of the rotor 31 is approximately 630 W and the rotation number of the compressor motor 13 is controlled to a continuous rotation number which is slightly larger than the lower limit value (that is, 15 Hz) of the continuous control rotation number in accordance with the temperature control operations, as illustrated by the rotation number 159 of the compressor motor 13. Since this rotation number is lower than the rotation number (20 Hz) during ON time in the ON-OFF control of FIG. 9, it is possible to improve the controllability in a region between the continuous rotation number control at a lower speed and the ON-OFF control, in which the range of heat absorption between the continuous rotation number control at a lower speed and the ON-OFF control at 20 Hz is overlapped.

Figure 13:
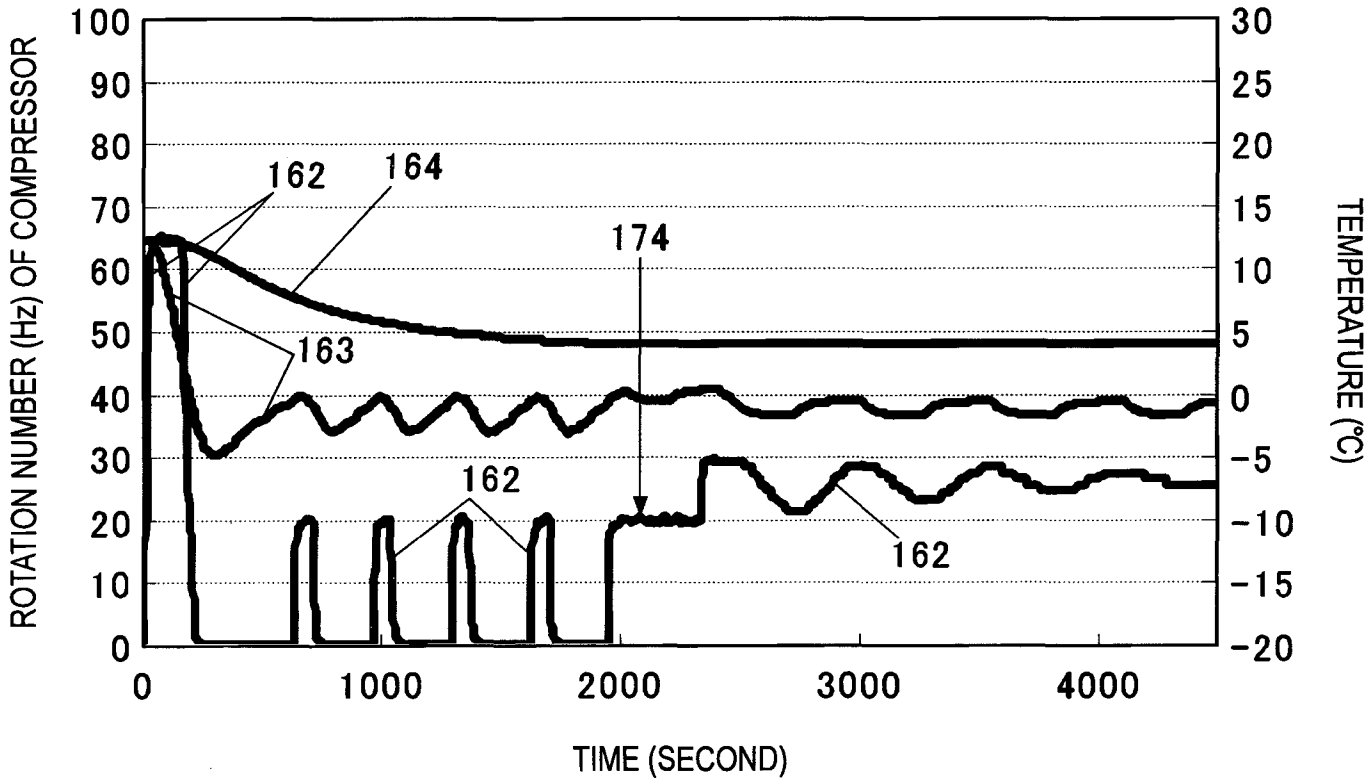
FIG. 13 is a view illustrating an actual measured example of a centrifuge according to the fourth exemplary embodiment of the present invention, in the control of rotating R22A4 type rotor at rotation number of 10000 $min^{-1}$, cooling and maintaining the temperature of a sample at 4° C., and then changing the rotation number to 12000 $min^{-1}$ at this state.

FIG. 13 is a view illustrating an actual measured example of the temperature control of the centrifuge 1 in such a way of rotating R22A4 type rotor at the rotation number of 10000 $min^{-1}$, cooling and maintaining the temperature of a sample at 4° C., and then changing the rotation number to 12000 $min^{-1}$ at this state. In contrary to FIG. 11, the control of the rotation number (unit: Hz) 163 of the compressor motor 13 is changed from the ON-OFF control of 20 Hz to the PID continuous rotation number control in accordance with the temperature control operations, as illustrated by the rotation number (unit: Hz) 162 of the compressor motor 13. The target control temperature of the temperature sensor 40*a* is initially approximately −1° C. and becomes approximately −2° C. after the setting change of the rotation number. Similar to FIG. 11, the rotation number 162 of the compressor motor 13 is set as 65 Hz at 0 to 200 seconds at the start of the temperature control and continuously lowered to 15 Hz by a continuous rotation number control using the PID control. After that, the ON-OFF control is performed.

Thereafter, if the rotation number of the rotor 31 increases from 10000 $min^{-1}$ to 12000 $min^{-1}$ at the change timing of preset rotation number 174 in the vicinity of approximately 2000 seconds, the windage loss of the rotor 31 slightly increases. Accordingly, a state where the detected temperature of the temperature sensor 40*a* is larger than new target control temperature of −2° C. by 0.5° C. is continued over 180 seconds when the rotation number of the compressor motor 13 is in a state of ON state at 25 Hz. In this way, the control device 20 causes the compressor motor 13 to be subjected to the continuous rotation number control using the PID control. The control situation after that is same as in FIG. 12.

The initial rotation number 162 of the compressor motor 13 after migration to the PID control of continuous rotation becomes 30 Hz in the vicinity of approximately 1900 seconds to 2300 seconds. As the PID control starts, the temperature of the rotor 31 is prevented from being excessively dropped due to excessive rotation number. This relationship is summarized in FIG. 14. Specifically, when the target control temperature and the detected temperature of the temperature sensor 40*a* are close to each other within a predetermined range in several times, the initial rotation number of the compressor motor 13 at the start of the PID control is set to be changed again as a rotation number which is calculated by multiplying a coefficient obtained from the ratio of a preset rotation number to a settable maximum rotation number of the rotor 31, to a predetermined maximum continuous rotation number of the compressor motor 13. When the ratio (%) of the preset rotation number to the maximum rotation number of the rotor 31 is equal or less than 65%, the rotation number (Hz) of the compressor motor 13 is set as 30 Hz as a whole. For example, when the rotor 31 has a maximum rotation number of 22000 rpm and a preset rotation number of 12000 rpm, the ratio of the preset rotation number to the maximum rotation number of the rotor 31 is 54.5%. That is, this ratio is less than 65% and therefore the initial rotation number of the compressor motor 13 at the start of the PID control is set as 30 Hz, as illustrated in FIG. 14.

Herein, the initial rotation number of the compressor motor 13 is dependent from the windage loss of the rotor 31 at the start of the PID control. Accordingly, first, the amount of heat generation of the rotor is calculated from the windage loss coefficient of the rotor group registered in advance and the rotating speed of the rotor 31 during operation and used as a coefficient. And then, the rotation number of the compressor motor may be reset by multiplying the coefficient to the maximum continuous rotation number of the compressor motor 13.

[Exemplary Embodiment 5]

Figure 19:
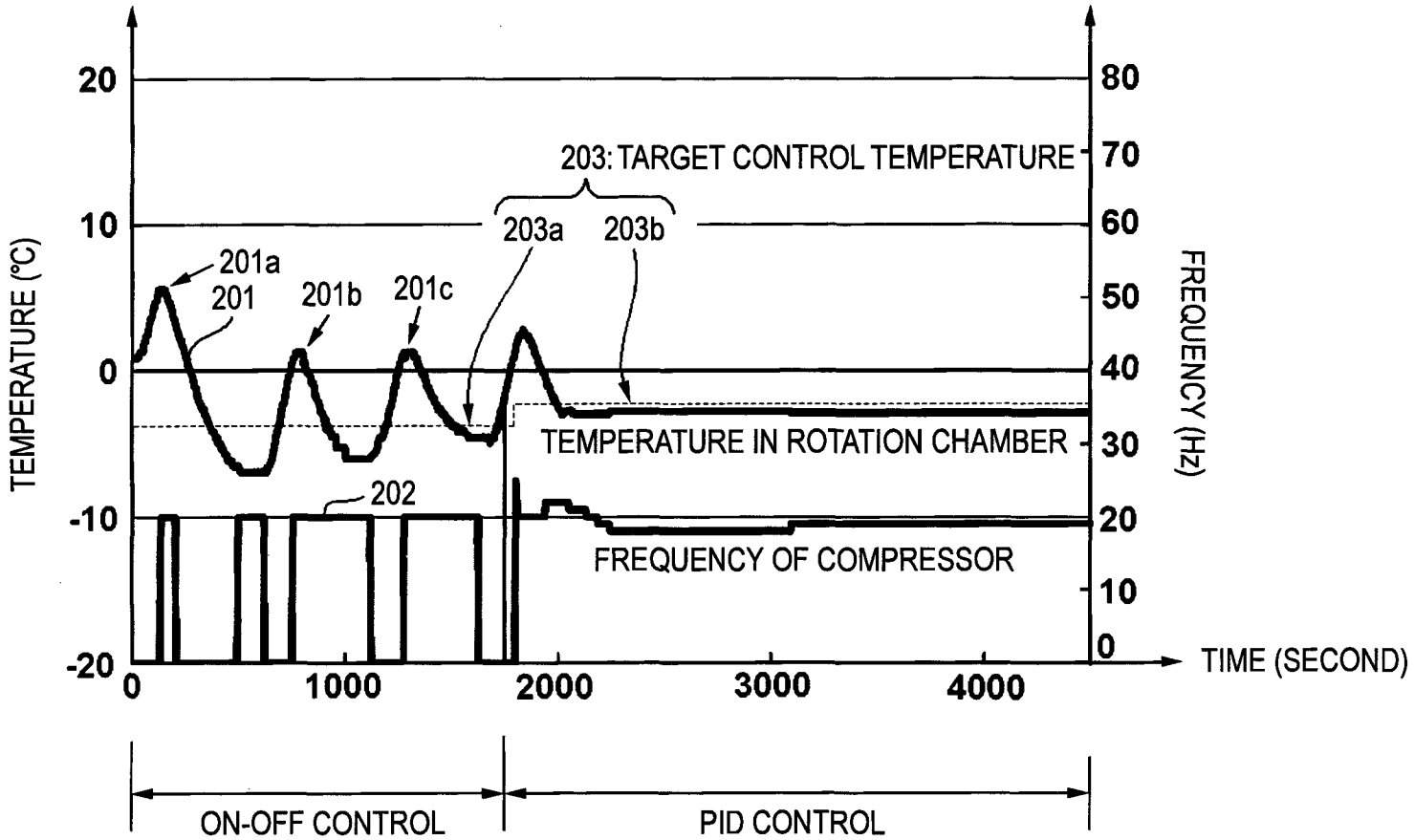
FIG. 19 is a view illustrating an example of a relationship between the control of a compressor motor 13 and the temperature of a rotation chamber when a centrifuge according to a fifth exemplary embodiment of the present invention is in a stabilization state.

Next, a control method of the compressor motor 13 when a centrifuge according to a fifth exemplary embodiment of the present invention is in a stabilization state will be described by referring to FIGS. 19 to 21. The centrifuge has a plurality of temperature control means (initial operation, PID control, ON-OFF control) using a variable speed compressor. In these controls, reference temperatures used in the temperature control are provided in plural to correspond to the temperature control means. FIG. 19 illustrates an example of a relationship between the control of the compressor motor 13 and the temperature of a rotation chamber 48. In FIG. 19, a state where the interior of the rotation chamber 48 is sufficiently cooled and thus a cooling procedure by ON-OFF control is carried out is migrating to PID control. At this time, the control device 20 cools the interior of the rotation chamber 48 to a target control temperature 203 in order to make the rotor 31 to a preset temperature by a cooling machine.

In the variable speed compressor, there is a constraint that the operating time of the compressor motor 13 is in continuous ON state of at least 30 seconds and in continuous OFF state of at least 60 seconds. The reason is that ON state is required when the pressure difference between the suction pipe 42 and the discharge pipe 36 is smaller than a predetermined value and OFF state is required when the pressure difference is larger than the predetermined value, in consideration of oil lubrication of the compressor 35. Accordingly, in a related-art ON-OFF control, even in a case where the temperature in the interior of the rotation chamber 48 becomes larger than the target control temperature, the compressor motor 13 cannot be restarted until the time interval determined by the above constraint lapses. For this reason, there is a risk that the temperature in the interior of the rotation chamber 48 becomes higher than the preset temperature 203*a*, as illustrated by arrows 201*a*, 201*b* and 201*c*. On contrary, in the control of the variable speed compressor after switching to PID control, the compressor motor 13 is controlled to continue in the ON state to approach near the target control temperature. Accordingly, the temperature in the interior of the rotation chamber 48 is uniformly maintained without being influenced by the constraints on the operating time, as compared to ON-OFF control.

According to the study of the present inventors, it was found that errors are caused in the sample temperature after the temperature control when the target control temperature for controlling the temperature in the interior of the rotation chamber 48 are same in these two temperature control modes (ON-OFF control, PID control). Further, it was found that the temperature control mode may be switched due to a condition such as room temperature even if the target control temperature 203 is same and thus the target control temperature should not be uniformly set in order to control the temperature in the interior of the rotation chamber 48. For this reason, according to the fifth exemplary embodiment, in the temperature control of the variable speed compressor in a state where the rotation of the rotor 31 is stabilized and the temperature in the interior of the rotation chamber 48 is sufficiently cooled, the target control temperature (reference control temperature) used in each temperature control mode is corrected depending on the temperature control mode or provided in plural.

The control device 20 has two operating modes which include PID control for driving and maintaining the compressor motor 13 at a proper rotating speed based on the detected temperature of the temperature sensor 40*a* and ON-OFF control for intermittently operating the compressor motor 13 at a predetermined rotating speed based on the detected temperature of the temperature sensor. At this time, the target control temperature 203 for controlling the temperature in the interior of the rotation chamber 48 is controlled to operate the compressor motor 13 in such a way that the target control temperature is determined/registered (preset temperature 203*b*) by a temperature control mode 1 (PID control) when the rotor 31 rotates in a rotating speed higher than the predetermined value determined for each type of the rotor 31 and determined/registered (preset temperature 203*a*) by a temperature control mode 2 (ON-OFF control) when the rotor 31 rotates in a rotating speed lower than the predetermined value determined for each type of the rotor 31.

In such a control, the target control temperature 203 for controlling the temperature in the interior of the rotation chamber 48 or a control threshold and the control mode (PID control or ON-OFF control) used for determining the target control temperature are registered together in a microcomputer (not illustrated) in the control device 20. Registered temperature is adjusted as follows. (1) Even if the target control temperature is determined by PID control and registered in the microcomputer, the control threshold (preset temperature 203*a* relative to preset temperature 203*b*) is determined as a temperature lower than the target control temperature by 1° C. when the control mode is switched to ON-OFF control during the operation of the rotor. (2) Even if the control threshold is determined by ON-OFF control and registered in the microcomputer, the target control temperature (preset temperature 203*a* relative to preset temperature 203*b*) is determined as a temperature higher than the control threshold by 1° C. when the control mode is switched to PID control during the operation of the rotor. In this way, the control threshold in PID control and ON-OFF control is different from each other by a predetermined temperature (in this exemplary embodiment, 1° C.). Accordingly, it is possible to allow the temperature in the interior of the rotation chamber 48 to be closer to the target control temperature, thereby controlling the temperature with high precision. Meanwhile, the temperature difference between the preset temperatures 203*a* and 203*b* is not limited to 1° C. but may be properly selected depending on the type of the rotor 31 and the target control temperature 203.

Figure 20:
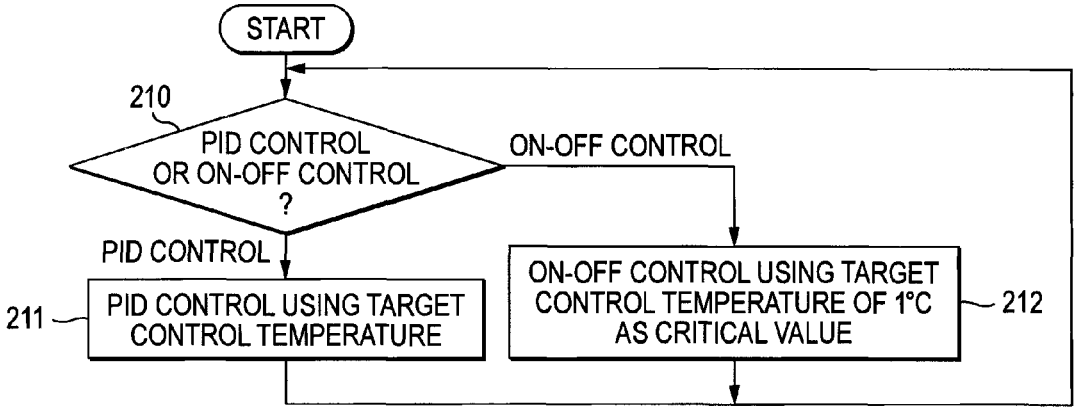
FIG. 20 is a flow-chart illustrating a setup procedure of a target control temperature in PID control and ON-OFF control when the centrifuge according to the fifth exemplary embodiment of the present invention is in a stabilization state.

FIG. 20 is a flow-chart illustrating a setup procedure of a target control temperature in PID control and ON-OFF control when the centrifuge according to the fifth exemplary embodiment of the present invention is in a stabilization state. In operation, the rotor 31 is placed into the rotation chamber 48 and a door 43 is closed. Thereafter, the preset rotation number of the centrifuge, centrifuging time and preset temperature etc. are set by the operating panel 21. And then, the control device 20 identifies the type of the rotor 31 mounted and is controlled to operate the compressor motor 13 in accordance with information such as the target control temperature and a control mode (PID control or ON-OFF control) of the variable speed compressor during stabilization, based on the distribution parameter stored in the storage device. The procedures of the flowchart illustrated in FIG. 19 are performed during this operation and the control device 20 determines whether the cooling machine during the operation thereof is in PID control mode or ON-OFF control mode (STEP 210). In a case of PID control mode, the PID control is carried out using the set target control temperature (STEP 211) and then the procedure returns to STEP 210. In a case of ON-OFF control, ON-OFF control is carried out using a corrected value as the target control temperature (STEP 212) and then the procedure returns to STEP 210. Herein, the corrected value is a value obtained by correcting the target control temperature stored in the above storage means by −1° C. In this way, in the present exemplary embodiment, the temperature rise of the rotation chamber 48 during ON-OFF control is controlled to be suppressed by correcting the target control temperature by −1° C. Accordingly, it is possible to control the temperature with high precision.

As a modification of the fifth exemplary embodiment, it is possible to further improve the accuracy of the ON-OFF control. This is realized by measuring the temperature of the rotation chamber 48, time-integrating the deviation of the measured temperature from the target temperature, and then switching the compressor motor to ON or OFF state at a timing when the integral value of positive deviation and the integral value of negative deviation are same as each other or within a predetermined ratio during each temperature hunting in accordance with ON-OFF of the compressor, in a case where the temperature in the interior of the rotation chamber 48 is controlled by ON-OFF of the variable speed compressor. FIG. 21 illustrates an example in which the compressor motor 13 is controlled depending on the accumulated area obtained by controlling the compressor to ON or OFF state relative to the target control temperature as illustrated by line 222.

Figure 21:
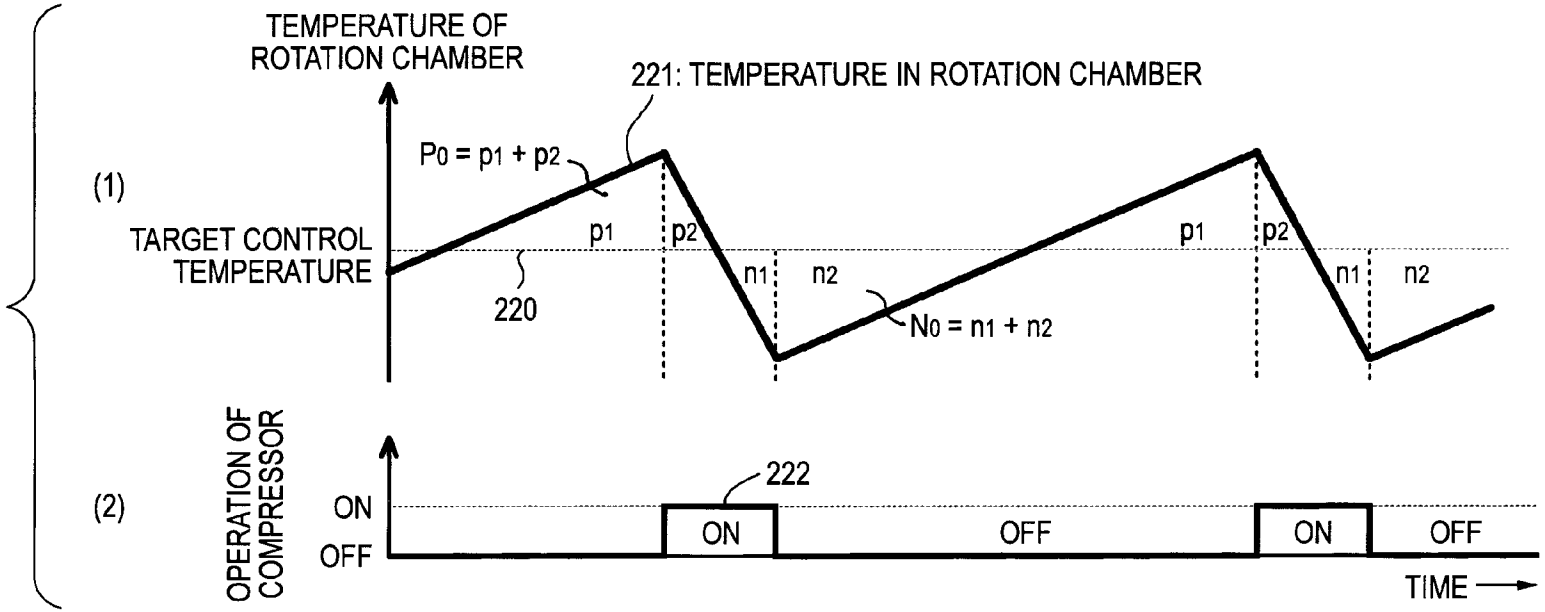
FIG. 21 is a view illustrating an example of a control procedure of the compressor motor 13 according to a modification of the fifth exemplary embodiment of the present invention.

FIG. 21 is a view illustrating an example of a control procedure of the compressor motor 13 according to a modification of the fifth exemplary embodiment of the present invention. Herein, in a case where the temperature in the interior of the rotation chamber 48 is controlled by ON-OFF of the variable speed compressor, the temperature of the rotation chamber 48 is measured, the deviation of the measured temperature from the target temperature 220 is time-integrated, and then the compressor motor is switched to ON or OFF state at a timing when the integral value of positive deviation and the integral value of negative deviation are same as each other or within a predetermined ratio during each temperature hunting in accordance with ON-OFF of the compressor. Specifically, when the temperature of the rotation chamber 48 is controlled by the ON-OFF control mode, the temperature control is carried out as follows. The deviation between the temperature of the rotation chamber 48 the control threshold is integrated and the integral value of positive deviation is referred to as PO, as illustrated in FIG. 21. Further, the integral value of positive deviation is referred to as p1 when the compressor is in OFF state and the integral value of positive deviation is referred to as p2 when the compressor is in ON state. Similarly, the integral value of negative deviation is referred to as NO, the integral value of negative deviation is referred to as n1 when the compressor is in ON state and the integral value of negative deviation is referred to as n2 when the compressor is in OFF state. And, the variable speed compressor is controlled as follows in order to allow the integral value of positive deviation PO and the integral value of negative deviation NO to be equal. (1) when the compressor is in ON state, the compressor is switched to OFF state in a case where $A*PO \leq n1$ is established (where, A is a predetermined coefficient). (2) when the compressor is in OFF state, the compressor is switched to ON state in a case where A'*NO<p1 is established (where, A' is a predetermined coefficient). (3) The average of the hunted temperature of the rotation chamber 48 can be approached to the target control temperature 220 by repeating above (1) and (2). Accordingly, it is possible to improve the control accuracy of the rotor temperature.

According to the present exemplary embodiment, the temperature for controlling the temperature of the rotation chamber 48 can be automatically adjusted, even if the temperature control mode is switched by the change of conditions such as room temperature. Thereby, the errors of the sample temperature due to the temperature control mode, which have occurred in a related-art control can be eliminated. Further, since the operation of the variable speed compressor is controlled using the integral value calculated from the deviation between the target control temperature and the temperature of the rotation chamber 48, it is possible to perform temperature control with high precision while reducing the effects of the mechanical constraints. In this way, it is expected that the sample temperature can be maintained in a range of the preset temperature ±2° C.

[Exemplary Embodiment 6]

Figure 22:
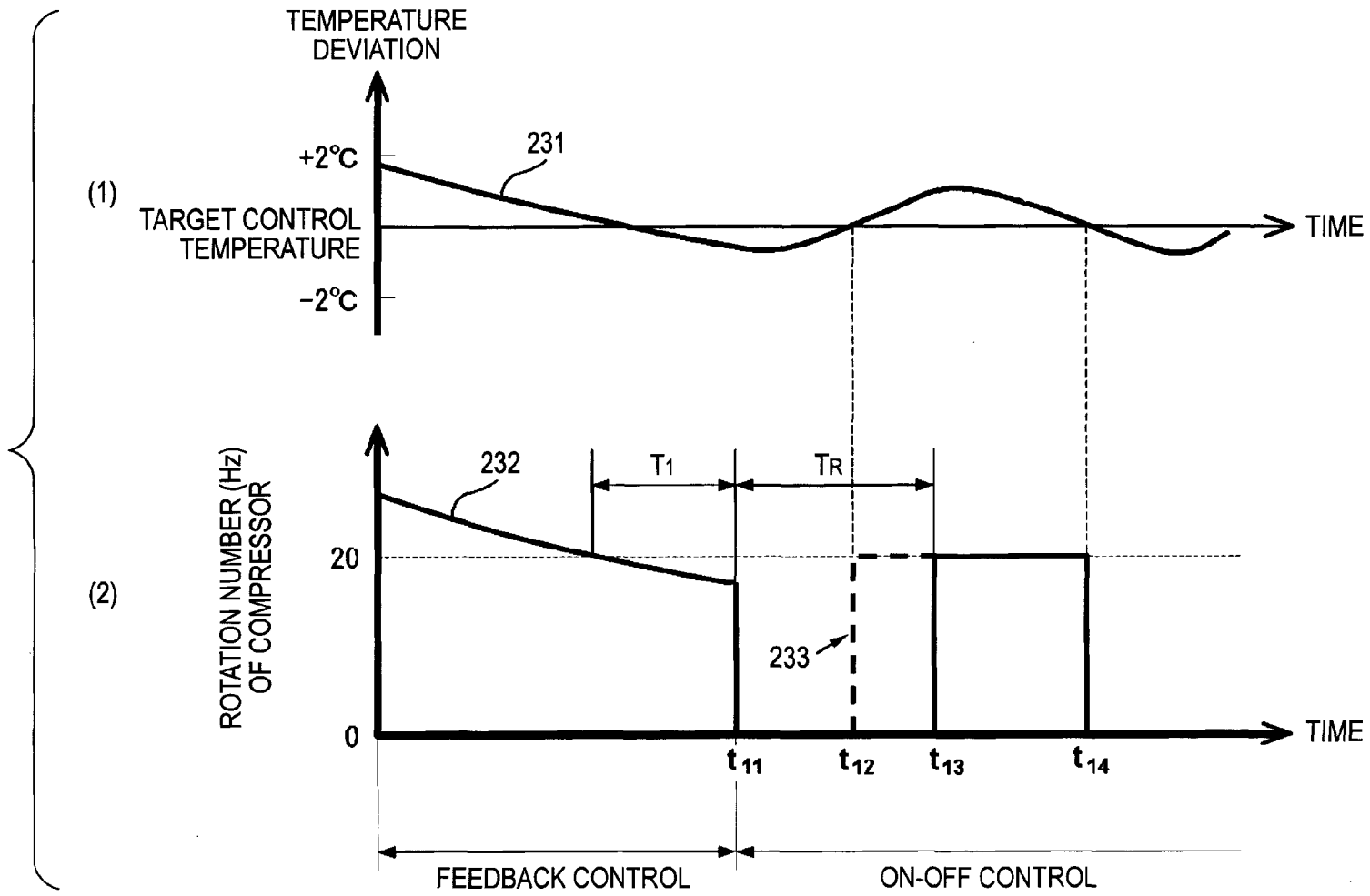
FIG. 22 is a view illustrating an example of a migrating procedure from feedback control to ON-OFF control in the compressor motor 13 according to a sixth exemplary embodiment of the present invention.

Next, a specific method for changing the control mode from the feedback control (or PID control) to ON-OFF control in the sixth exemplary embodiment of the present invention will be described by referring to FIGS. 22 to 25. FIG. 22 is a view illustrating an example of a migrating procedure from feedback control to ON-OFF control in the compressor motor 13 according to the sixth exemplary embodiment. FIG. 22 (1) is a view illustrating the behavior of the measured temperature 231 of the temperature sensor 40*a* relative to the target control temperature. FIG. 22 (2) illustrates the rotation number 232 of the compressor motor 13, at that time. Hereinafter, a below time is referred to a time where the rotation number 232 is below a predetermined frequency, that is, a switching reference rotation number (20 Hz, in this exemplary embodiment) which is higher than a minimum continuous rotation number (lower limit). The control device 20 is controlled to intermittently operate the compressor motor 13 in such a way that the feedback control is switched to ON-OFF control when the below time reaches a predetermined time T1 at time t11. Herein, TR represents a start inhibit time of the refrigerant machine. Essentially, it is ideal that the compressor motor 13 is restarted at the time t12 when the measured temperature 231 exceeds the target control temperature, as illustrated by dotted line 233. However, because the start inhibit time TR of the refrigerant machine has not lapsed at time t12, the compressor motor 13 is restarted at time t13 after the start inhibit time TR has lapsed. When the compressor motor is restarted, the rotation number of the compressor is 20 Hz which is switching reference rotation number. And then, the compressor is stopped when the measured temperature 231 is below again the target control temperature at time t14 due to the restart of the compressor. Thereafter, as the same control is repeated, the rotation number becomes larger than switching reference rotation number and then the start inhibit time TR has lapsed, the compressor motor 13 is restarted. By controlling in this way, migration from feedback control to ON-OFF control can be done without causing temperature change as far as possible.

Figure 23:
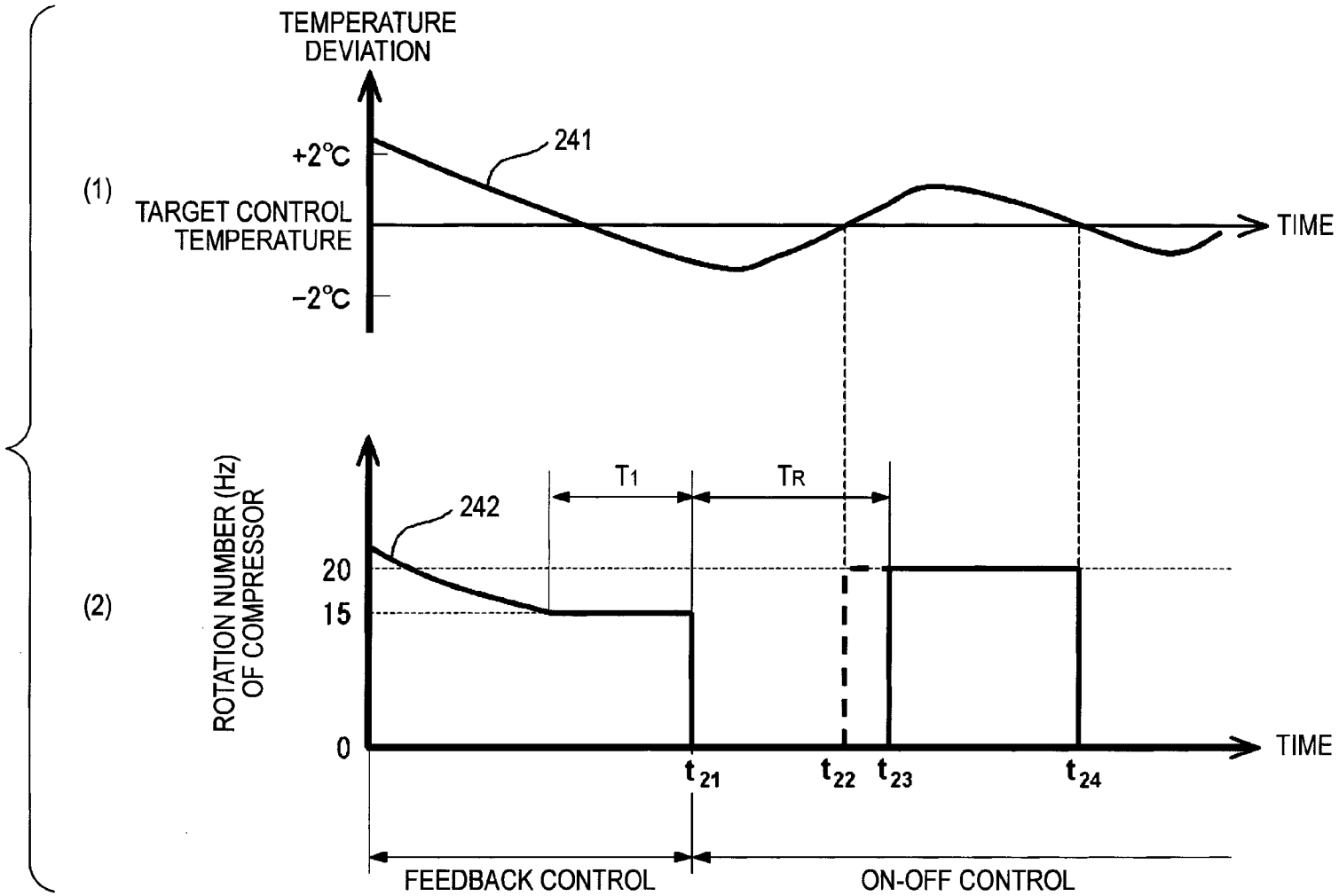
FIG. 23 is a view illustrating an example of a migrating procedure from feedback control to ON-OFF control in the compressor motor 13 according to a modification of the sixth exemplary embodiment of the present invention.

FIG. 23 is a view illustrating an example of a migrating procedure from feedback control to ON-OFF control in the compressor motor 13 according to a modification the sixth exemplary embodiment. FIG. 23 (1) is a view illustrating the behavior of the measured temperature 241 of the temperature sensor 40*a* relative to the target control temperature. FIG. 23 (2) illustrates the rotation number 242 of the compressor motor 13, at that time. The control device 20 is controlled to intermittently operate the compressor motor 13 in such a way that the feedback control is switched to ON-OFF control at time t21 when the predetermined time T1 has lapsed in a state where the rotation number 242 reaches the minimum continuous rotation number (lower limit, 15 Hz). Herein, TR represents a start inhibit time of the refrigerant machine. Essentially, it is ideal that the compressor motor 13 is restarted at the time t22 when the measured temperature 241 exceeds the target control temperature. However, because the start inhibit time TR of the refrigerant machine has not lapsed at time t22, the compressor motor 13 is restarted at time t23 after the start inhibit time TR has lapsed. When the compressor motor is restarted, the rotation number of the compressor is not 15 Hz which is the minimum continuous rotation number but 20 Hz which is the switching reference rotation number. And then, the compressor is stopped when the measured temperature 241 is below again the target control temperature at time t24 due to the restart of the compressor. Thereafter, as the same control is repeated, the rotation number becomes larger than switching reference rotation number and then the start inhibit time TR has lapsed, the compressor motor 13 is restarted. By controlling in this way, migration from feedback control to ON-OFF control can be done without causing temperature change as far as possible.

Figure 24:
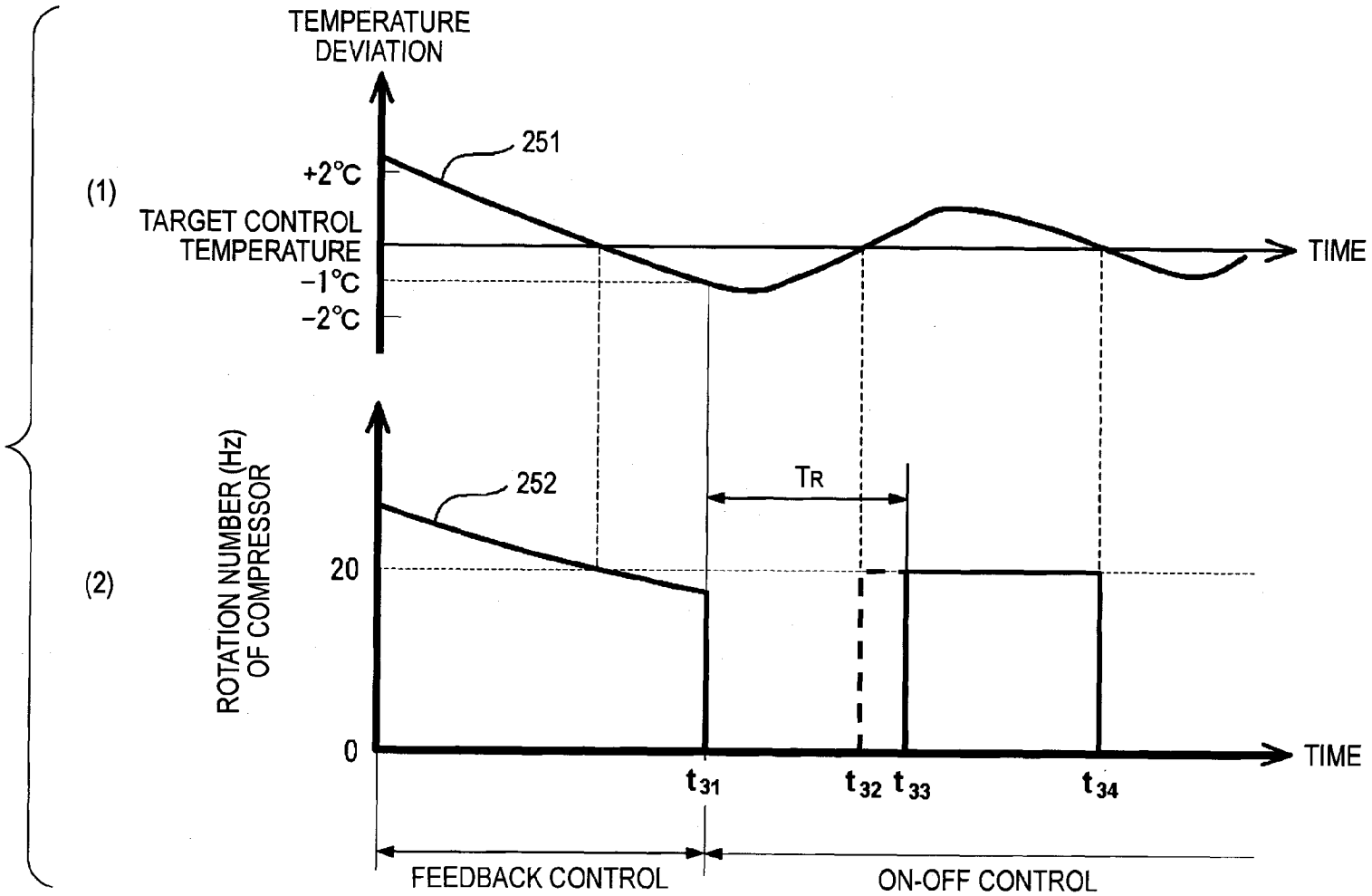
FIG. 24 is a view illustrating an example of a migrating procedure from feedback control to ON-OFF control in the compressor motor 13 according to a second modification of the sixth exemplary embodiment of the present invention.

FIG. 24 is a view illustrating an example of a migrating procedure from feedback control to ON-OFF control in the compressor motor 13 according to a modification 2 of the sixth exemplary embodiment. FIG. 24 (1) is a view illustrating the behavior of the measured temperature 251 of the temperature sensor 40*a* relative to the target control temperature. FIG. 24 (2) illustrates the rotation number 252 of the compressor motor 13, at that time. The control device 20 is controlled to stop the compressor motor 13 in such a way that the feedback control is switched to ON-OFF control at time t31 when the rotation number 252 is below a predetermined frequency, that is, the switching reference rotation number (20 Hz, in this exemplary embodiment) which is higher than the minimum continuous rotation number (lower limit) and the measured temperature is lower than the target control temperature minus 1° C. Herein, TR represents a start inhibit time of the refrigerant machine. Essentially, it is ideal that the compressor motor 13 is restarted at the time t32 when the measured temperature 251 exceeds the target control temperature, as illustrated by dotted line 233. However, because the start inhibit time TR of the refrigerant machine has not lapsed at time t32, the compressor motor 13 is restarted at time t33 after the start inhibit time TR has lapsed. When the compressor motor is restarted, the rotation number of the compressor is 20 Hz which is switching reference rotation number. And then, the compressor is stopped when the measured temperature 251 is below again the target control temperature at time t34 due to the restart of the compressor. Thereafter, as the same control is repeated, the rotation number becomes larger than switching reference rotation number and then the start inhibit time TR has lapsed, the compressor motor 13 is restarted. By controlling in this way, migration from feedback control to ON-OFF control can be done without causing temperature change as far as possible.

Figure 25:
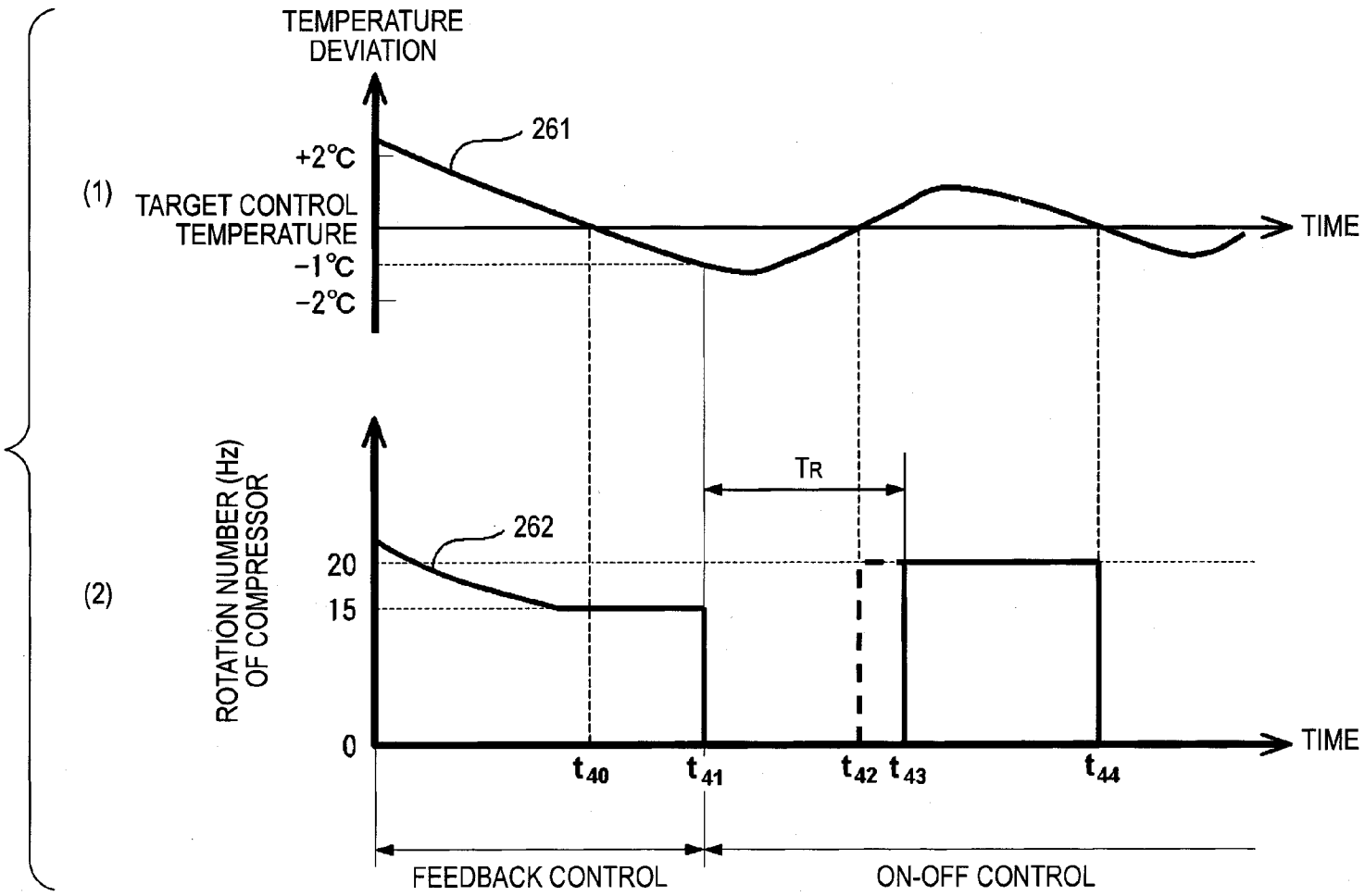
FIG. 25 is a view illustrating an example of a migrating procedure from feedback control to ON-OFF control in the compressor motor 13 according to a third modification of the sixth exemplary embodiment of the present invention.

FIG. 25 is a view illustrating an example of a migrating procedure from feedback control to ON-OFF control in the compressor motor 13 according to a modification 3 of the sixth exemplary embodiment. FIG. 25 (1) is a view illustrating the behavior of the measured temperature 261 of the temperature sensor 40*a* relative to the target control temperature. FIG. 25 (2) illustrates the rotation number 262 of the compressor motor 13, at that time. The control device 20 is controlled to continuously operate the compressor motor 13 at the minimum continuous rotation number when the rotation number 262 reaches the minimum continuous rotation number (lower limit) of 15 Hz and to stop the compressor motor 13 in such a way that the feedback control is switched to ON-OFF control at time t41 when the measured temperature is lower than the target control temperature minus 1° C. Herein, TR represents a start inhibit time of the refrigerant machine. Essentially, it is ideal that the compressor motor 13 is restarted at the time t42 when the measured temperature 261 exceeds the target control temperature, as illustrated by dotted line 233. However, because the start inhibit time TR of the refrigerant machine has not lapsed at time t42, the compressor motor 13 is restarted at time t43 after the start inhibit time TR has lapsed. When the compressor motor is restarted, the rotation number of the compressor is 20 Hz which is switching reference rotation number. And then, the compressor is stopped when the measured temperature 261 is below again the target control temperature at time t44 due to the restart of the compressor. Thereafter, as the same control is repeated, the rotation number becomes larger than switching reference rotation number and then the start inhibit time TR has lapsed, the compressor motor 13 is restarted. By controlling in this way, migration from feedback control to ON-OFF control can be done without causing temperature change as far as possible.

[Exemplary Embodiment 7]

Figure 26:
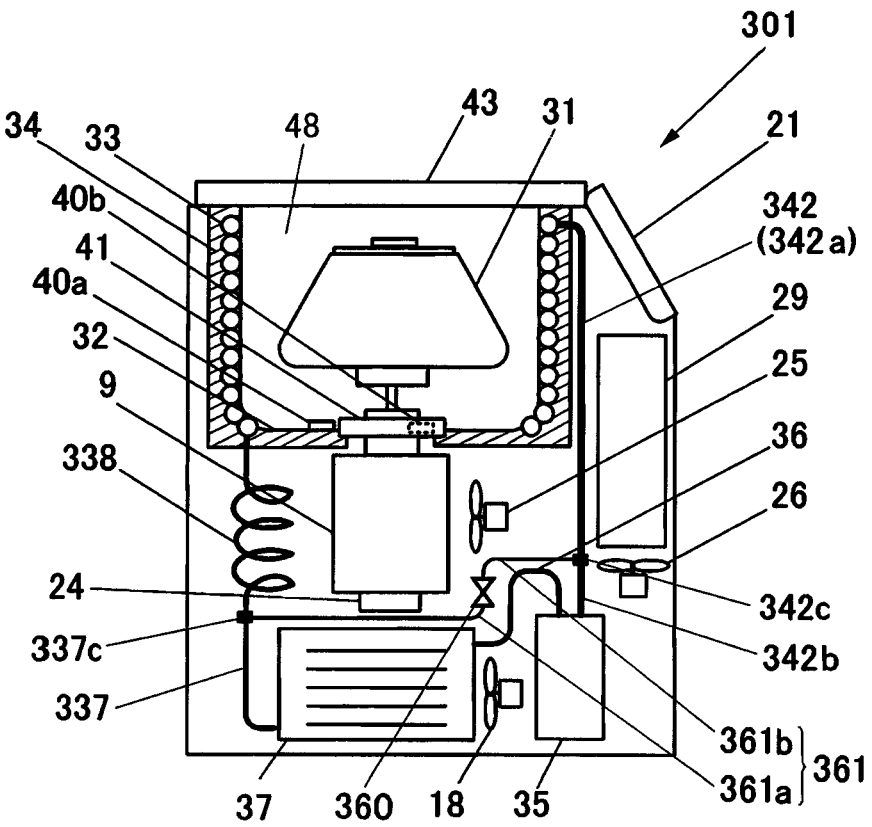
FIG. 26 is a block diagram of a centrifuge 301 according to a seventh exemplary embodiment of the present invention.

FIG. 26 is a section view schematically illustrating an entire configuration of a centrifuge 301 according to the seventh exemplary embodiment of the present invention. Herein, the same or similar element will be denoted by the same reference numeral as that of the centrifuge 1 explained in FIG. 1, and the duplicated explanation thereof will be omitted.

The pipe evaporator 33 is wound around an outer periphery of the chamber 32. A compressor 35 is provided for compressing a refrigerant to supply the refrigerant in a circulation manner and includes a compressor motor 13. The compressor supplies the compressed refrigerant from a discharge pipe 36 to a condenser 37. The refrigerant is radiated and cooled by the condenser 37 so that the refrigerant is liquefied. Further, the refrigerant is sent to a lower portion of the evaporator 33 through a supply line 337 and a capillary 338. The evaporator 33 absorbs heat of the rotation chamber 48 during the vaporization of the refrigerant and thus cools the rotation chamber 48. Vaporized refrigerant is discharged from the top of the evaporator 33 and returns to the compressor 35 through return lines (suction pipe) 342*a*, 342*b*. In the present exemplary embodiment, a branch means 337*c* is provided in a line extending from the condenser 37 to the capillary 338 via the supply line 337. Further, a bypass line 361 (361*a*, 361*b*) is provided for shorting the return line 342 from the supply line 337. Further, a valve 360 is provided in the bypass line 361 and can be electrically controlled by the control device 20 disposed in the control box 29. Thereby, the bypass line 361 is divided into an upstream side line 361*a* and a downstream side line 361*b* by the valve 360, as viewed from a flowing direction of the refrigerant. The downstream side line 361*b* is connected to a branch means 342*c* which is provided in the return line 342. Herein, T-shaped branch pipe or other three branch pipe can be employed as the branch means 337*c*, 342*c*. Since the bypass line 361 (361*a*, 361*b*) is provided in this way, it is possible to allow the liquefied refrigerant to bypass the capillary 338 and the evaporator 33. The valve 360 is constituted with an openable electromagnetic valve which can be controlled in two stages of "open" and "close." However, a variable electromagnetic valve of which the opening area can be changed from 0 to maximum in a continuous manner or in stages and of which flow can be adjusted. The valve 360 is closed during normal operation of the cooling machine. However, the valve is properly opened or closed when the rotation chamber 48 is sufficiently cooled and thus the cooling machine is migrated from feedback control (PID control)) to ON-OFF control.

A temperature sensor 40*a* is provided at a portion contacting a metal part in a bottom of the chamber 32 in which the rotor 31 is accommodated and indirectly detects the temperature of the rotor 31. The control device 20 is controlled to open and close of the valve 360 using the output of the temperature sensor 40*a*. At this time, most of the refrigerant does not go to the evaporator 33 when the valve 360 is opened. Accordingly, the rotation chamber is not cooled. In the present exemplary embodiment, the bypass line 361 is used to control the ON or OFF of a related-art compressor motor 13. The rotation chamber 48 is cooled to the target control temperature with high precision without stopping the compressor motor 13 or by stopping the compressor motor 13 and then controlling ON(open)/OFF(close) of the valve 360.

When the refrigerant is supplied to the compressor 35 while being remained in a liquid state, there is a possibility that the service life of the compressor 35 is reduced or the compressor 35 is damaged. Accordingly, as an operating condition of the compressor 35, it is desirable to supply the refrigerant to the compressor 35 in a vaporized (gaseous) state. For this reason, in the present exemplary embodiment, a throttle part is provided in the bypass line 361 to promote the vaporization of the refrigerant. The shape of the throttle part is optional. For example, a part of a small sectional area which is formed by narrowing a flow passage may be provided in a part of the line. Alternatively, the sectional area of the opening may be reduced by the valve 360 or other throttle. Further, an inner diameter of the pipe constituting the line may be reduced to form the throttle part. In the present exemplary embodiment, the sectional area (inner diameter) of the downstream side line 361*b* of the bypass line 361 extending from the valve 360 to the return line 342 is set larger than the sectional area (inner diameter) of the capillary 338 and smaller than the sectional area of the return line (B) 342*b*. Specifically, an inner diameter of the downstream side line 361*b* is set to 1.8 mm and a length thereof is set to 300 mm Meanwhile, an inner diameter of the capillary 338 is set to 1.5 mm and a length thereof is set to 3 m. An inner diameter of the upstream side line 361*a* of the bypass line 361 is set equal to the inner diameter (9.5 mm) of the discharge pipe 36 so as to allow the refrigerant to smoothly flow therethrough.

When the valve 360 is opened by control of the control device 20, the refrigerant flows out of the condenser 37 toward the supply line 337 and most of the refrigerant flows toward the bypass line 361 with less flow resistance at the branch means 337*c*. And then, the refrigerant flows through the upstream side line 361*a* and then flows through the downstream side line 361*b* which has an inner diameter (sectional area) smaller than that of the upstream side line 361*a*. And then, the refrigerant is joined to the return line 342 via the branch means 342*c* and then vaporized. In this state, the refrigerant flows through the return line (B) 342*b* and returns to the compressor 35. In this way, the time for balancing the pressure of the high-pressure side discharge pipe 36 and the pressure of the return line (B) 342*b* can be shorten to about 20 seconds, as compared to 2 minutes in the prior art. Further, since the refrigerant in a vaporized state can be supplied to the compressor 35, there is no risk of reducing the service life of the compressor. In addition, since the pressure of the high-pressure side discharge pipe 36 and the pressure of the return line 342 can be balanced in a short time, it is possible to shorten the restart time of the compressor.

Meanwhile, the inserted position of the valve 360 is not limited to a position illustrated in FIG. 26. For example, an electromagnetic switching valve such as three-way valve may be provided in the branch means 337*c* or the branch means 342*c*. Further, the type of the valve 360 provided in the bypass line 361 is not limited to the electromagnetic valve. For example, other valve or open-close means may be used as long as the open and close thereof can be controlled by the control device 20. Further, in the present exemplary embodiment, the minimum sectional area of the line is adjusted by reducing the inner diameter of the bypass line, for example. Alternatively, the upstream side line 361*a* and the downstream side line 361*b* of the bypass line 361 are formed to have same inner diameter and the valve 360 is replaced to adjust the flow of the refrigerant. Further, the control device 20 controls the opening degree of the valve 360 to adjust the flow rate of the refrigerant. In this way, the liquefied refrigerant is vaporized to return to the compressor 35.

Further, although the branch means 337*c* is provided in the vicinity of the upstream side of the capillary 338 in the present exemplary embodiment, the position of the branch means 337*c* is not limited to this place. For example, the branch means 337*c* may be provided in several positions between the compressor 35 and capillary 338, in a case where the condenser 37 is not used. Alternatively or in addition to the valve 360, an openable valve which can be electromagnetically controlled may be provided in the line at the side of the capillary 338 or in the return line (A). Further, the compressor motor may not be an inverter type motor.

Figure 27:
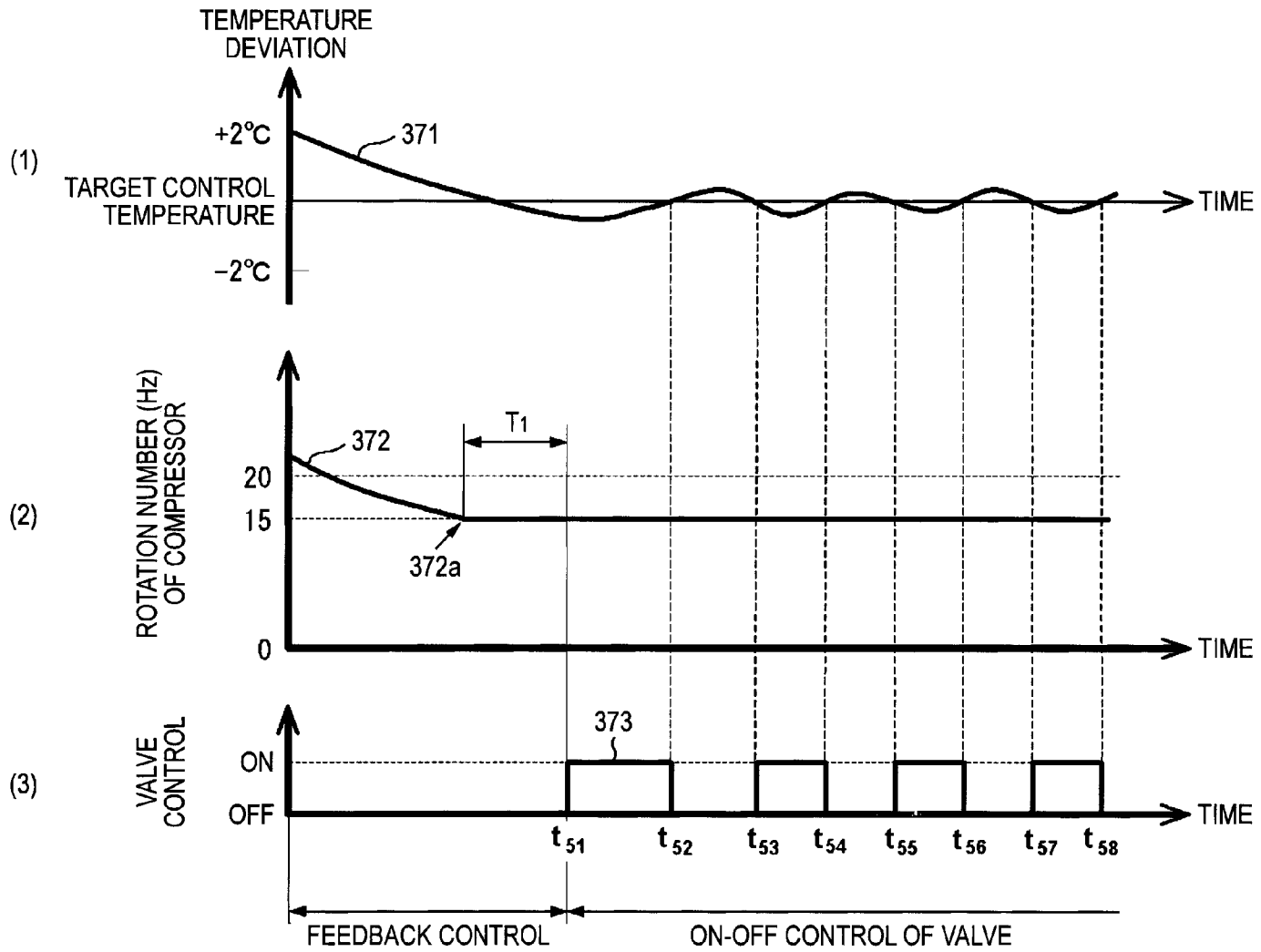
FIG. 27 is a view illustrating an example of a temperature control procedure using a valve 360 of the centrifuge 301 according to the seventh exemplary embodiment of the present invention.

FIG. 27 is a view illustrating an example of a temperature control procedure using a valve 360 of the centrifuge 301 according to the sixth exemplary embodiment of the present invention. Each graph in (1) to (3) of FIG. 27 is illustrated together with time axis (horizontal axis). FIG. 27 (1) is a graph illustrating a state of the target control temperature of the rotating chamber 48 and the measured temperature 371 of the temperature sensor 40*a*, FIG. 27 (2) is a graph illustrating the rotation number 372 of the compressor and FIG. 27 (3) is a graph illustrating a state of ON-OFF control of the valve 360. ON state of the valve 360 is referred to a state where the valve is opened and thus the bypass line 361 is in a communication state. Further, OFF state of the valve 360 is referred to a state where the valve is closed and thus the bypass line 361 is in a closed state. The control device 20 is controlled by feedback control mode to lower the rotation number 372 of the compressor in accordance with the measuring temperature 371 of the rotation chamber 48. However, the control device is controlled to continuously operate the compressor motor 13 at the minimum continuous rotation number when the rotation number reaches the minimum continuous rotation number (lower limit) of 15 Hz, as illustrated by arrow 372*a*. Herein, the feedback control is switched to ON-OFF control of the valve 360 at time t51 when the predetermined time T1 has lapsed in a state where the rotation number reaches the minimum continuous rotation number (lower limit, 15 Hz). At this time, on the contrary to the fifth exemplary embodiment, the compressor motor 13 is continued to perform intermittent operation at the minimum continuous rotation number (lower limit, 15 Hz) or a rotation number (for example, about 20 Hz) slightly higher than the minimum continuous rotation number. And then, the valve 360 is switched to OFF state to send the refrigerant from the compressor 35 to the evaporator 33 when the valve 360 is switched to ON state and thus the measured temperature 371 rises again to the target control temperature at time t52. Thereafter, the same control is repeated. The valve 360 is switched to ON state when the measured temperature becomes lower than the target control temperature (t53, t55, t57) and the valve 360 is switched to ON state when the measured temperature becomes higher than the target control temperature (t54, t56, t58). At this time, there are no time constraints on the interval of the ON-OFF of the valve 360. By controlling in this way, it is possible to realize the target control temperature simply by opening/closing the valve 360 without stopping the compressor motor 13.

Figure 28:
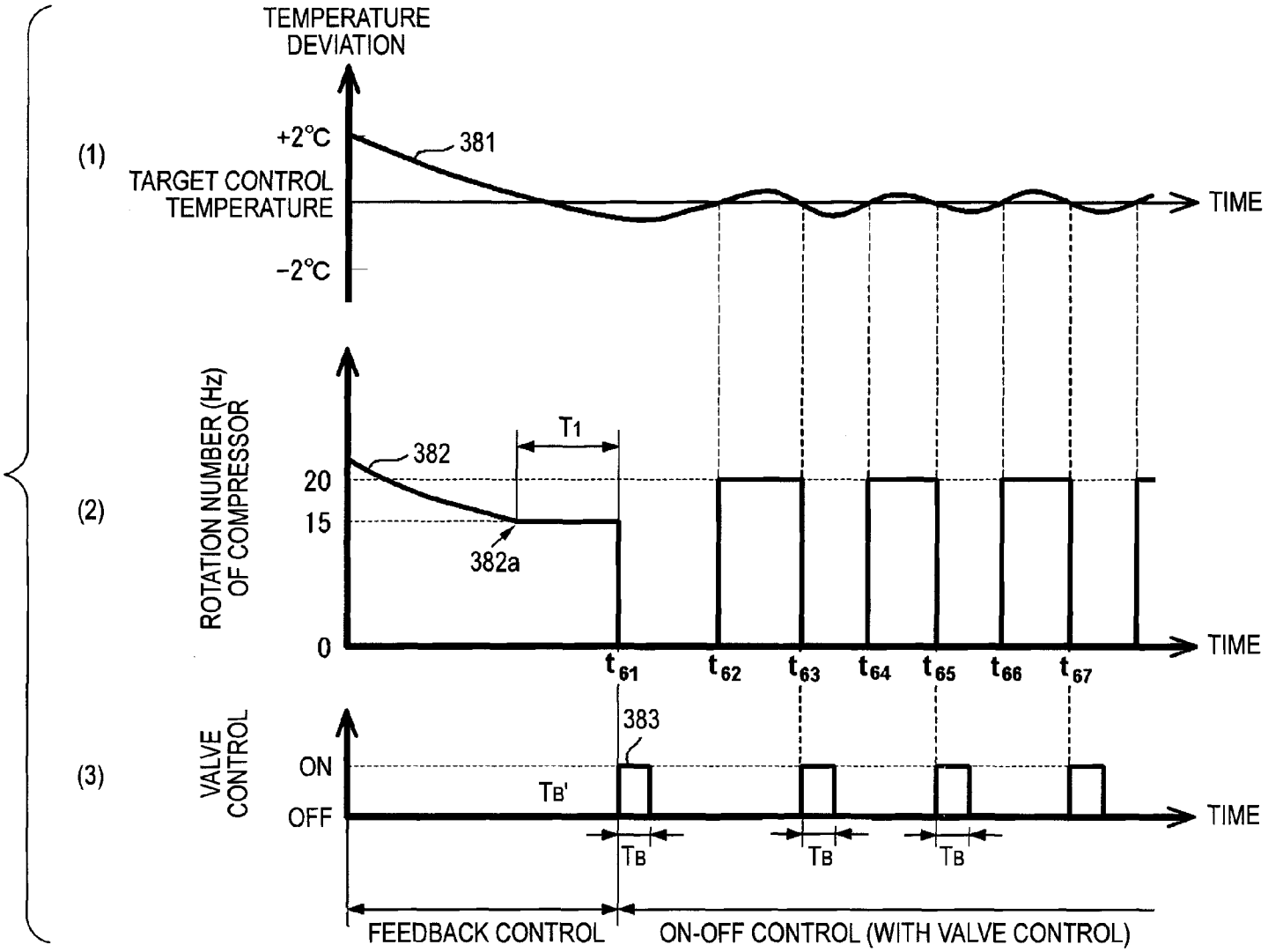
FIG. 28 is a view illustrating an example of a temperature control procedure using a valve 360 of the centrifuge 301 according to a modification of the seventh exemplary embodiment of the present invention.

FIG. 28 is a view illustrating an example of a temperature control procedure using a valve 360 of the centrifuge 301 according to a modification of the sixth exemplary embodiment of the present invention. Each graph in (1) to (3) of FIG. 28 is illustrated together with time axis (horizontal axis). FIG. 28 (1) is a graph illustrating a state of the target control temperature of the rotating chamber 48 and the measured temperature 381 of the temperature sensor 40*a*, FIG. 28 (2) is a graph illustrating the rotation number 382 of the compressor and FIG. 28 (3) is a graph illustrating a state of ON-OFF control of the valve 360. In FIG. 27, ON-OFF of the valve 360 is controlled in a state where the compressor 35 is operating. On the contrary, in the present exemplary embodiment, ON-OFF control of the compressor 35 and ON-OFF control of the valve 360 are carried out in parallel. The control device 20 is controlled by feedback control mode to lower the rotation number 382 of the compressor in accordance with the measuring temperature 381 of the rotation chamber 48. However, the control device is controlled to continuously operate the compressor motor 13 at the minimum continuous rotation number when the rotation number reaches the minimum continuous rotation number (lower limit) of 15 Hz, as illustrated by arrow 382*a*. Herein, the feedback control is switched to ON-OFF control of the compressor at time t61 when the predetermined time T1 has lapsed in a state where the rotation number reaches the minimum continuous rotation number (lower limit, 15 Hz). At this time, the valve 360 is switched to ON state in a short time TB from time t61 to eliminate the pressure difference between the supply line extending from the condenser 37 to the capillary 338 and the suction pipe (return line) 342. That is, the pressure therebetween is balanced. Subsequently, the compressor is restarted (ON) when the measured temperature 381 rises again to the target control temperature at time t62. Next, the compressor is stopped (OFF) when the measured temperature 381 drops again to the target control temperature at time t63 and the valve 360 is switched to ON state in a short time TB from time t63. Thereafter, the same control is repeated. The compressor is switched to ON state when the measured temperature becomes higher than the target control temperature (t64, t66, t68) and the compressor is switched to OFF state when the measured temperature becomes lower than the target control temperature (t65, t67). Herein, the predetermined time TB in which the valve 360 is opened may be selected to eliminate the pressure difference between the supply line and the return line. For example, the predetermined time TB may be approximately 30 seconds. By eliminating the pressure difference between the supply line and the return line in this way, it is possible to reduce or eliminate constraints on the restart inhibit time of the compressor.

Hereinabove, although the present invention has been specifically described based on respective exemplary embodiment, the present invention is not limited to the above exemplary embodiment. For example, the present invention can be variously modified without departing from the gist of the present invention.

What is claimed is:

1. A centrifuge comprising:

a rotor configured to be driven by a motor and to hold a sample;

a centrifuge inverter configured to supply power to drive the motor;

a chamber accommodating the rotor;

a temperature sensor configured to detect the temperature of the chamber;

a cooling machine configured to cool the chamber and including a compressor;

a compressor inverter configured to supply power to the compressor;

a compressor motor incorporated to the compressor and configured to be controlled in a variable speed by the power supplied from the compressor inverter; and a control device configured to control the centrifuge inverter and the compressor inverter based on set centrifuging operation conditions, wherein the control device carries out a feedback control of the compressor motor based on a preset temperature and a detected temperature of the temperature sensor when a rotation number of the compressor motor is larger than a predetermined rotation number, and the control device carries out an intermittent control for turning ON-OFF the cooling function of the compressor when the rotation number of the compressor motor is smaller than the predetermined rotation number.

2. The centrifuge according to claim 1, wherein the rotation number of the compressor motor, which is compared with the predetermined rotation number, is calculated by the control device by using a difference between the preset temperature and the detected temperature of the temperature sensor.

3. The centrifuge according to claim 2, wherein the calculation is a PID calculation.

4. The centrifuge according to claim 1, further comprising an input unit to which the preset temperature is input, wherein the control device is configured to set a target control temperature for making the rotor to the preset temperature based on the inputted preset temperature and is configured to carry out a feedback control of the compressor motor based on the target control temperature and the detected temperature of the temperature sensor.

5. The centrifuge according to claim 4, wherein the control device controls the cooling function of the compressor to ON state when, during the intermittent control, the detected temperature of the temperature sensor is higher than the target control temperature and the rotation number of the compressor motor is larger than a set minimum continuous rotation number.

6. The centrifuge according to claim 5, wherein the rotation number of the compressor motor, which is compared with the predetermined rotation number, is calculated by the control device by using a difference between the preset temperature and the detected temperature of the temperature sensor, and wherein when the rotation number obtained by the calculation which uses the detected temperature of the temperature sensor as a feedback information and is based on a difference between the target control temperature and the detected temperature of the temperature sensor is higher than the minimum continuous rotation number at the start of the temperature control of the rotor, a rotation number, which is obtained by multiplying a coefficient obtained from a ratio of the preset rotation number of the rotor and a settable maximum rotation number of the rotor to a maximum continuous rotation number, is used as the preset rotation number of the compressor motor.

7. The centrifuge according to claim 5, wherein the rotation number of the compressor motor, which is compared with the predetermined rotation number, is calculated by the control device by using a difference between the preset temperature and the detected temperature of the temperature sensor, and wherein when the rotation number obtained by the calculation which uses the detected temperature of the temperature sensor as a feedback information and uses a difference between the target control temperature and the detected temperature of the temperature sensor is higher than the minimum continuous rotation number at the start of the temperature control of the rotor, a rotation number, which is obtained by multiplying an amount of heat generation of the rotor calculated from a windage loss coefficient of the rotor registered in advance and a rotating speed of the rotor during operation as a coefficient to the maximum continuous rotation number, is used as the preset rotation number of the compressor motor.

8. The centrifuge according to claim 4, wherein the control device is configured to stop the intermittent control and transit to the feedback control when the detected temperature of the temperature sensor is higher than the target control temperature for a predetermined continuous time during the intermittent control.

9. The centrifuge according to claim 1, wherein the temperature sensor is installed to contact with a metal part of a lower portion of the chamber.

10. The centrifuge according to claim 1, wherein the control device monitors whether a state where the rotation number of the compressor motor is lower than a predetermined rotation number has continued for the predetermined time or not and whether the rotation number of the compressor motor has reached a set minimum continuous rotation number or not, and when it is determined that the state where the rotation number of the compressor motor is lower than the predetermined rotation number has continued for the predetermined time or the rotation number of the compressor motor has reached the set minimum continuous rotation number, the control device carries out an intermittent control of the cooling function of the compressor.

11. The centrifuge according to claim 1, wherein the control device is configured to control the compressor motor to ON state or OFF state during the intermittent control.

12. The centrifuge according to claim 11, wherein when the compressor motor is controlled to OFF state during the intermittent control, the OFF state is maintained for at least a minimum off time.

13. The centrifuge according to claim 1, further comprising:

an evaporator, a supply line for supplying a refrigerant compressed by the compressor to the evaporator, a return line extending from the evaporator to the compressor, a bypass line for bypassing the evaporator by shorting the return line and the supply line, and a valve provided in the bypass line, wherein the control device is configured to control the valve to ON state or OFF state during the intermittent control.

14. The centrifuge according to claim 13, wherein the control device is configured to control the compressor motor to rotate at a minimum continuous rotation number when the valve is controlled to OFF state.

15. The centrifuge according to claim 14, wherein the control device is configured to control the valve to ON state or OFF state and is configured to control the compressor motor to a continuous operation state or an intermittent operation state during the intermittent control.

16. The centrifuge according to claim 15, wherein the control device is configured to control the ON time of the valve to be shorter than the interval of the intermittent operation when the compressor motor is controlled to the intermittent operation state.

17. The centrifuge according to claim 13, further comprising:

the compressor configured to compress a refrigerant which is supplied to the evaporator in a circulation manner;

a capillary provided between the compressor and the evaporator; and a throttle part provided to a part of the bypass line, wherein the evaporator is configured to cool the chamber, wherein the return line connects the evaporator and the compressor, wherein the bypass line connects an inlet side of the capillary and the return line, and wherein the valve allows the refrigerant to flow through the bypass line.

18. The centrifuge according to claim 17, wherein the throttle part is formed by narrowing the diameter of the bypass line, and a sectional area of the throttle part is set larger than a minimum sectional area of the capillary and smaller than a minimum sectional area of the return line.

19. The centrifuge according to claim 17, wherein a condenser configured to heat-dissipate the refrigerant compressed by the compressor is provided between the compressor and an inlet of the capillary.

20. The centrifuge according to claim 19, further comprising a switching device configured to switch a flow of the refrigerant flowing from the compressor to the capillary to a flow toward the bypass line.

21. The centrifuge according to claim 17, wherein the valve is a variable valve in which the flow rate can be adjusted in a variable manner and serves as the throttle part by adjusting the flow rate thereof.

22. The centrifuge according to claim 17, wherein the control device is configured to control the intermittent operation or the continuous operation of the compressor, and wherein the control device is configured to control ON-OFF of the valve during the intermittent operation or the continuous operation.

23. The centrifuge according to claim 17, wherein the control device is configured to control open-close of the valve when the rotation number of the compressor motor becomes lower than the a predetermined rotation number.

24. The centrifuge according to claim 23, wherein the control device is configured to control ON-OFF of the compressor motor when the rotation number of the compressor motor becomes lower than the predetermined rotation number, and wherein the control device is configured to switch the valve from the open state to the closed state at least during OFF state of the motor.

* * * * *